US011788728B2

(12) United States Patent
Shindle et al.

(10) Patent No.: US 11,788,728 B2
(45) Date of Patent: Oct. 17, 2023

(54) HOT SURFACE IGNITERS FOR COOKTOPS

(71) Applicant: SCP Holdings, Auburn, IN (US)

(72) Inventors: Jack A. Shindle, Leo, IN (US); Bruce C. Sprowl, Auburn, IN (US); Yin Liu, Fort Wayne, IN (US)

(73) Assignee: SCP R&D, LLC, Auburn, IN (US)

( * ) Notice: Subject to any disclaimer, the term of this patent is extended or adjusted under 35 U.S.C. 154(b) by 0 days.

(21) Appl. No.: 17/959,898

(22) Filed: Oct. 4, 2022

(65) Prior Publication Data

US 2023/0038340 A1 Feb. 9, 2023

Related U.S. Application Data

(62) Division of application No. 16/366,479, filed on Mar. 27, 2019, now Pat. No. 11,493,208.

(60) Provisional application No. 62/781,588, filed on Dec. 18, 2018, provisional application No. 62/648,574, filed on Mar. 27, 2018.

(51) Int. Cl.

| | |
|---|---|
| ***F24C 3/10*** | (2006.01) |
| ***F23N 5/24*** | (2006.01) |
| ***F23Q 7/12*** | (2006.01) |
| ***F23Q 7/10*** | (2006.01) |
| ***F24C 3/08*** | (2006.01) |
| ***F24C 3/12*** | (2006.01) |

(Continued)

(52) U.S. Cl.

CPC ..... *F24C 3/103* (2013.01); *F23N 5/24* (2013.01); *F23Q 7/10* (2013.01); *F23Q 7/12* (2013.01); *F24C 3/085* (2013.01); *F24C 3/126* (2013.01); *F24C 15/108* (2013.01); *F23D 14/06* (2013.01)

(58) Field of Classification Search

CPC ..... F24C 3/103
USPC ..... 431/6, 263; 219/267; 126/39 R, 39 E
See application file for complete search history.

(56) References Cited

U.S. PATENT DOCUMENTS

| | | | |
|---|---|---|---|
| 3,426,953 | A | 2/1969 | Metzger et al. |
| 3,597,139 | A | 8/1971 | Elders |

(Continued)

FOREIGN PATENT DOCUMENTS

| | | |
|---|---|---|
| GB | 1094522 | 12/1967 |
| JP | 2-251014 A | 10/1990 |

(Continued)

OTHER PUBLICATIONS

International Search Report and Written Opinion for PCT/US2019/024344 dated Aug. 2, 2019.

(Continued)

*Primary Examiner* — Vivek K Shirsat
(74) *Attorney, Agent, or Firm* — Hansen IP Law PLLC

(57) ABSTRACT

Hot surface igniter assemblies used in cooktops are shown and described. The hot surface igniters include a silicon nitride ceramic body with an embedded, resistive, heat-generating circuit. The igniters are less than 0.04 inches thick, and when energized, they reach surface temperatures in excess of 2000° F. in under 4 seconds to ignite combustible gas such as propane, butane, or natural gas. Examples of cook top burner systems are also provided which allow the igniter to remain on after ignition at a power level that is lower than during ignition but high enough to ignite the cooking gas should a flame out occur. Examples are also provided of burners that ignite on a low flow setting (e.g., simmer) as opposed the high flow settings that are common in cook top industry.

16 Claims, 12 Drawing Sheets

(51) Int. Cl.
*F24C 15/10* (2006.01)
*F23D 14/06* (2006.01)

(56) References Cited

U.S. PATENT DOCUMENTS 3,806,308 A 4/1974 Cahoe et al.
3,823,345 A 7/1974 Mitts et al.
3,840,768 A 10/1974 White et al.
3,906,341 A 9/1975 Getz et al.
3,906,342 A 9/1975 Pfouts
4,029,936 A 6/1977 Schweitzer
4,205,363 A 5/1980 Boos et al.
4,405,299 A 9/1983 Serber
4,486,651 A 12/1984 Atsumi et al.
4,493,402 A 1/1985 Hattori
4,560,343 A 12/1985 Bohan, Jr.
4,587,941 A 5/1986 Mishina et al.
4,634,837 A 1/1987 Ito et al.
4,641,043 A 2/1987 Adams et al.
4,789,330 A 12/1988 Ballard et al.
4,804,823 A 2/1989 Okuda et al.
4,815,524 A 3/1989 Dempsey et al.
4,850,852 A 7/1989 Bailard et al.
4,883,947 A 11/1989 Murase et al.
4,891,004 A 1/1990 Ballard et al.
4,912,305 A 3/1990 Tatemasu et al.
4,925,386 A 5/1990 Donnelly et al.
4,951,870 A 8/1990 Ballard et al.
4,978,293 A 12/1990 Ryno
5,002,038 A 3/1991 Riehl
5,003,161 A 3/1991 Geary
5,035,607 A 7/1991 Peterson
5,076,494 A 12/1991 Ripka
5,112,217 A 5/1992 Ripka et al.
5,133,656 A 7/1992 Peterson
5,233,166 A 8/1993 Maeda et al.
5,240,406 A 8/1993 Kanesaka
5,249,096 A 9/1993 Williams
5,264,681 A 11/1993 Nozaki et al.
5,324,194 A 6/1994 Bruce et al.
5,379,853 A 1/1995 Lockwood et al.
5,435,717 A 7/1995 Bohan et al.
5,458,011 A 10/1995 Thompson
5,492,469 A 2/1996 Oda et al.
5,514,630 A 5/1996 Willkens et al.
5,522,541 A 6/1996 Zia et al.
5,544,645 A 8/1996 Armijo et al.
5,560,851 A 10/1996 Thimm et al.
5,624,252 A 4/1997 Charles, Sr. et al.
5,725,368 A 3/1998 Aresmeier
5,731,594 A 3/1998 Kuroda et al.
5,750,958 A 3/1998 Okuda et al.
5,767,026 A 6/1998 Kondoh et al.
5,785,911 A 7/1998 Willkens et al.
5,786,565 A 7/1998 Willkens et al.
5,791,890 A 8/1998 Maughan
5,801,361 A 9/1998 Willkens et al.
5,804,092 A 9/1998 Axelson et al.
5,813,394 A 9/1998 Clifford
5,820,789 A 10/1998 Willkens et al.
5,865,612 A 2/1999 Hill et al.
5,892,201 A 4/1999 Croucher et al.
5,916,467 A 6/1999 Shimada
6,002,107 A 12/1999 Willkens et al.
6,028,292 A 2/2000 Willkens et al.
6,030,205 A 2/2000 Maughan
6,084,220 A 7/2000 Suematsu et al.
6,089,219 A 7/2000 Kodera et al.
6,168,418 B1 1/2001 Levinson
6,216,683 B1 4/2001 Maughan
6,217,312 B1 4/2001 Levinson et al.
6,278,087 B1 8/2001 Willkens et al.
6,359,261 B1 3/2002 Watanabe et al.
6,474,492 B2 11/2002 Willkens et al.
6,479,949 B1 11/2002 Nerone et al.
6,548,787 B2 4/2003 Natsuhara et al.
6,562,745 B2 5/2003 Willkens et al.
6,563,089 B2 5/2003 Watanabe et al.
6,572,363 B1 6/2003 Virgil, Jr. et al.
6,582,629 B1 6/2003 Lin et al.
6,621,052 B2 9/2003 Watanabe et al.
6,657,166 B2 12/2003 Funaki et al.
6,728,600 B1 4/2004 Contaldo et al.
6,777,650 B1 8/2004 Hamel
6,777,653 B2 8/2004 Burkhart
6,929,874 B2 8/2005 Hiramatsu et al.
6,933,471 B2 8/2005 Hamel et al.
6,935,328 B2 8/2005 Haynes et al.
6,967,312 B2 11/2005 Hiramatsu et al.
7,204,688 B2 4/2007 Han
7,255,100 B2 8/2007 Repper et al.
7,291,009 B2 11/2007 Kamal et al.
7,329,837 B2 2/2008 Willkens
7,358,466 B1 4/2008 Meyers et al.
7,469,840 B2 12/2008 Donnelly et al.
7,538,297 B2 5/2009 Anderson et al.
7,559,293 B2 7/2009 Gordon et al.
7,638,297 B2 12/2009 Anderson et al.
7,647,762 B2 1/2010 Uselton
7,671,305 B2 3/2010 Chodacki et al.
7,675,005 B2 3/2010 Annavarapu et al.
7,772,525 B2 8/2010 Annavarapu et al.
7,772,780 B2 8/2010 Pokharna et al.
7,785,482 B2 8/2010 Subramanian et al.
7,786,409 B2 8/2010 Hamel et al.
7,900,589 B2 3/2011 Gordon et al.
7,935,912 B2 5/2011 Arima et al.
7,947,933 B2 5/2011 Nagasako et al.
7,982,166 B2 7/2011 Kukino et al.
8,167,610 B2 5/2012 Raleigh et al.
8,193,469 B2 6/2012 Willkens
8,302,593 B2 11/2012 Cadima
8,324,535 B2 12/2012 Maruyama
8,371,844 B2 2/2013 Querejeta Andueza et al.
8,413,648 B2 4/2013 Querejeta Andueza et al.
8,591,222 B2 11/2013 Sherrow
8,616,194 B2 12/2013 Sherrow et al.
8,634,179 B2 1/2014 Rubinshtein
8,757,137 B2 6/2014 Cadima
8,851,884 B2 10/2014 Querejeta Andueza et al.
8,878,104 B2 11/2014 Shaffer et al.
8,882,492 B2 11/2014 Querejeta Andueza et al.
8,899,223 B2 12/2014 Cadima
8,925,541 B2 1/2015 Thompson
8,985,999 B2 3/2015 Sherrow et al.
8,992,211 B2 3/2015 Kociecki et al.
9,004,058 B1 * 4/2015 Brown ..... F24C 3/002 126/30
9,068,752 B2 6/2015 Shaffer et al.
9,157,638 B2 10/2015 Ponziani et al.
9,188,343 B2 11/2015 Cadima et al.
9,200,847 B2 12/2015 Thompson
9,261,292 B2 2/2016 Sherrow
9,316,411 B2 4/2016 Sherrow et al.
9,574,774 B2 2/2017 Kobayashi
9,746,182 B2 8/2017 Blalock et al.
9,841,194 B2 12/2017 Paller
9,951,959 B2 4/2018 De Brosse et al.
10,036,555 B2 7/2018 Cadima et al.
10,119,701 B2 11/2018 Chase
10,156,378 B2 12/2018 Alsaleem
2002/0045142 A1 4/2002 Repper et al.
2002/0073985 A1 6/2002 Leukhardt, III et al.
2003/0160220 A1 8/2003 Lin et al.
2004/0060924 A1 4/2004 Burkhart
2004/0209209 A1 10/2004 Chodacki et al.
2005/0053884 A1 3/2005 Schmiedlin et al.
2005/0089809 A9 4/2005 Repper et al.
2005/0198917 A1 9/2005 Hokkirigawa et al.
2006/0201925 A1 9/2006 Yu et al.
2006/0213897 A1 9/2006 Annavarapu et al.
2006/0219691 A1 10/2006 Hamel et al.
2007/0007278 A1 1/2007 Chodacki et al.
2007/0154858 A1 7/2007 Cadima

(56) References Cited

U.S. PATENT DOCUMENTS

2007/0295708 A1 12/2007 Yu et al.
2007/0295709 A1 12/2007 Willkens
2008/0099465 A1 5/2008 Meyers et al.
2008/0216772 A1 9/2008 Gordon et al.
2008/0302776 A1 12/2008 Arima et al.
2008/0314890 A1 12/2008 Willkens
2009/0173729 A1 7/2009 Annavarapu et al.
2009/0179023 A1 7/2009 Annavarapu et al.
2009/0179027 A1 7/2009 Vartabedian et al.
2009/0206069 A1 8/2009 Hamel
2009/0317755 A1 12/2009 Kociecki et al.
2010/0108658 A1 5/2010 Chodacki et al.
2010/0116182 A1 5/2010 Chodacki et al.
2010/0141231 A1 6/2010 Duchene
2010/0213188 A1 8/2010 Nishihara et al.
2010/0310998 A1 12/2010 Raleigh et al.
2011/0031231 A1 2/2011 Arima et al.
2011/0086319 A1* 4/2011 Chodacki ..... F23Q 7/10 431/74
2011/0104622 A1 5/2011 Sherrow
2011/0207065 A1* 8/2011 Shaffer ..... F24C 3/103 431/73
2011/0233190 A1 9/2011 Kukino et al.
2012/0080023 A1 4/2012 Thompson
2012/0085832 A1 4/2012 Thompson
2012/0088199 A1 4/2012 Yantis et al.
2012/0125910 A1 5/2012 Shaffer et al.
2012/0180774 A1 7/2012 Reifel et al.
2012/0183910 A1 7/2012 Jaaz et al.
2012/0199109 A1 8/2012 Thompson
2012/0247444 A1 10/2012 Sherrow et al.
2012/0282560 A1 11/2012 Cadima
2013/0061844 A1 3/2013 Cadima
2013/0081611 A1 4/2013 Cadima
2013/0157075 A1 6/2013 Maruyama
2013/0224671 A1 8/2013 Carey et al.
2013/0252185 A1 9/2013 Shaw et al.
2014/0018677 A1 1/2014 Sharanov
2014/0020669 A1 1/2014 Sherrow et al.
2014/0034038 A1 2/2014 Sherrow et al.
2014/0074730 A1 3/2014 Arensmeier et al.
2014/0127570 A1 5/2014 Dandrea
2014/0186779 A1 7/2014 Chodacki et al.
2014/0196712 A1 7/2014 Cadima et al.
2014/0202443 A1 7/2014 Sherrow et al.
2014/0261386 A1 9/2014 Bringe et al.
2015/0010872 A1 1/2015 Schindler et al.
2015/0260411 A1 9/2015 Querejeta Andueza
2015/0276222 A1 10/2015 Kobayashi
2015/0323394 A1 11/2015 Alsaleem
2015/0323423 A1 11/2015 Alsaleem
2015/0330861 A1 11/2015 Alsaleem
2015/0338088 A1 11/2015 Chase
2015/0345821 A1 12/2015 Alsaleem
2015/0354834 A1 12/2015 Barone
2016/0003559 A1 1/2016 Bradbury et al.
2016/0109125 A1 4/2016 Willkens et al.
2016/0313049 A1 10/2016 Totaro
2016/0345767 A1 12/2016 Cadima
2016/0370015 A1 12/2016 Paller
2017/0127478 A1 5/2017 Okamura
2018/0031274 A1 2/2018 Wilson et al.
2018/0045418 A1 2/2018 Cook et al.
2018/0306491 A1 10/2018 Saunders et al.
2019/0139805 A1 5/2019 Muneishi

FOREIGN PATENT DOCUMENTS

WO 01029483 A1 4/2001
WO 2004083728 A1 9/2004

OTHER PUBLICATIONS

International Search Report and Written Opinion for PCT/US2019/024301 dated Aug. 2, 2019.
English translation of JP 2-251014 from Lexis Nexis Total Patent One.
Third Party Preissuance Submission Under 37 CFR Sec. 1.290 in the matter of U.S. Appl. No. 16/366,479 dated Sep. 1, 2020.
Hwan Soo Dow, Woo Sik Kim, and Jung Woo Lee, "Thermal and electrical properties of silicon nitride substrates", AIP Advances 7, 095022 (2017) https://doi.org/1 0.1063/1.4996314.

* cited by examiner

HOT SURFACE IGNITERS FOR COOKTOPS

CROSS-REFERENCE TO RELATED APPLICATIONS

This application is a divisional of U.S. patent application Ser. No. 16/366,479, filed Mar. 27, 2019, which claims the benefit of U.S. Provisional Patent Application No. 62/648,574, filed Mar. 27, 2018 and U.S. Provisional Patent Application No. 62/781,588, filed on Dec. 18, 2018, the entirety of each of which is hereby incorporated by reference.

FIELD

This disclosure relates to gas cooktops with burners that include hot surface igniter assemblies.

BACKGROUND

Gas cooktops include a set of burners, each of which receives and ignites cooking gas. The burner typically includes an orifice holder, which holds the orifice through which gas enters the burner, a crown, and a crown cap. The crown typically includes a plurality of flutes (orifices) arranged around its circumference through which combusting gas is directed in a radially outward direction. Gas enters the crown axially via the orifice, and a crown cap sits atop the orifice to redirect gas flowing upward through the flutes in a radially outward direction.

Typical burners also include a spark igniter to ignite the cooking gas. Certain spark igniters consist of a small, spring loaded hammer which hits a piezoelectric crystal when activated. The contact between the hammer and crystal causes a deformation and a large potential difference. The potential difference creates an electric discharge and a spark that ignites the gas. More recently, a small transformer is provided in the ignition circuit and steps up the 120V input voltage up to 10 orders of magnitude or greater to create the large potential difference that generates the electric discharge.

Spark igniters each typically spark with a potential difference of 10,000-12,000 volts. All of the igniters for each burner on a cooktop ignite simultaneously, regardless of which burner gas is being directed to. As a result, each spark ignition event involves a collective potential difference pulse equal to the number of burners times the 10-12 kV potential per igniter. This large potential difference pulse generates an electromotive force that can cause damage electronic components and lead to control board failures. In addition, customers often complain that the audible clicking sound of spark igniters is annoying.

Hot surface igniters are a possible alternative to spark igniters. Hot surface igniters are used to ignite combustion gases in a variety of appliances, including furnaces and clothing dryers. Some hot surface igniters, such as silicon carbide igniters, include a semi-conductive ceramic body with terminal ends across which a potential difference is applied. Current flowing through the ceramic body causes the body to heat up and increase in temperature, providing a source of ignition for the combustion gases.

Other types of hot surface igniters, such as silicon nitride igniters, include a ceramic body with an embedded circuit across which a potential difference is applied. Current flowing in the embedded circuit causes the ceramic body to heat up and increase in temperature, providing a source of ignition for combustion gases. However, using hot surface igniters in cooktop applications presents certain challenges.

The required ignition times for lighting cooktop burners are typically shorter than those for applications such as furnaces, boilers, etc. In addition, the envelope in which the igniter must function imposes constraints on the length, width, and thickness of the igniter. Because of these requirements, many existing hot surface igniters lack the combination of structural strength and low ignition times that are required in many cooktop applications.

In cooktop applications, it is also desirable to have a method for re-igniting the cooking gas in the event of loss of flame, and in some cases, to automatically detect the loss of flame. Existing control strategies and systems are not configured to re-ignite the cooking gas or to do so in an acceptable amount of time. It is further desirable to coordinate the supply of cooking gas and the energization of the hot surface igniter and to provide a user control that provides such coordination during ignition, cooking, and re-ignition.

Modern cooktops are typically configured such that ignition only occurs when the gas flow is on one of its highest settings. The igniter is typically in fluid communication with the gas source via an igniter orifice in the crown. At lower gas flow rates to the burner, the gas pressure may be insufficient to allow a combustible mixture of gas and air to form proximate the igniter. Igniting only at high gas flows ensures that an explosive mixture will form at the igniter and provides more reliable ignition. However, it wastes gas, can create an unanticipated gas ignition plume or can fill a room with unignited gas thus create an undesirable indoor environment. Thus, it would also be desirable to provide a burner system that comprises a hot surface igniter and which ignites or re-ignites on a lower gas flow rate to the burner.

Certain countries or geographical regions have industry standards that dictate ignition times and re-ignition times that igniters must meet. In the US and Canada, the ANSI (American National Standards Institute) Z21.1-2016 and CSA (Canadian Standards Association) 1.1-2016 standard governs household cooking gas appliances. In Chile Standard Nch1397 governs household appliances for cooking using gaseous fuels, and in Mexico Official Mexican Standard NOM-1010-SESH-2012 governs domestic appliances for cooking foods that use LP gas or natural gas. In some cases, these standards set minimum ignition times, minimum re-ignition times (following flame extinction) and minimum times for re-energizing the igniter. For example, ANSI Z211.1-2016 requires that ignition and re-ignition after extinction occur within four (4) seconds after gas is first available at the burner ports (to prevent uncombusted cooking gas from filling the area around the cooktop) and that if the igniter is de-energized following ignition, that it must be re-energized in not more than 0.8 second following the flame outage. The Official Mexican Standard NOM-1010-SESH-2012 has similar requirements, whereas the Chilean Nch1397 Standard allows for a five (5) second ignition time. The ANSI standard also specifies low and high cooking gas supply pressure scenarios under which the various minimum ignition times must be satisfied. Igniting or re-igniting on a lower gas flow rate can impact the ability of a burner system to satisfy such standards. Thus, it would be desirable to provide a burner system comprising a hot surface igniter that can ignite on lower gas flow rates while also satisfying one or more of the foregoing standards.

DESCRIPTION

Figure 1:
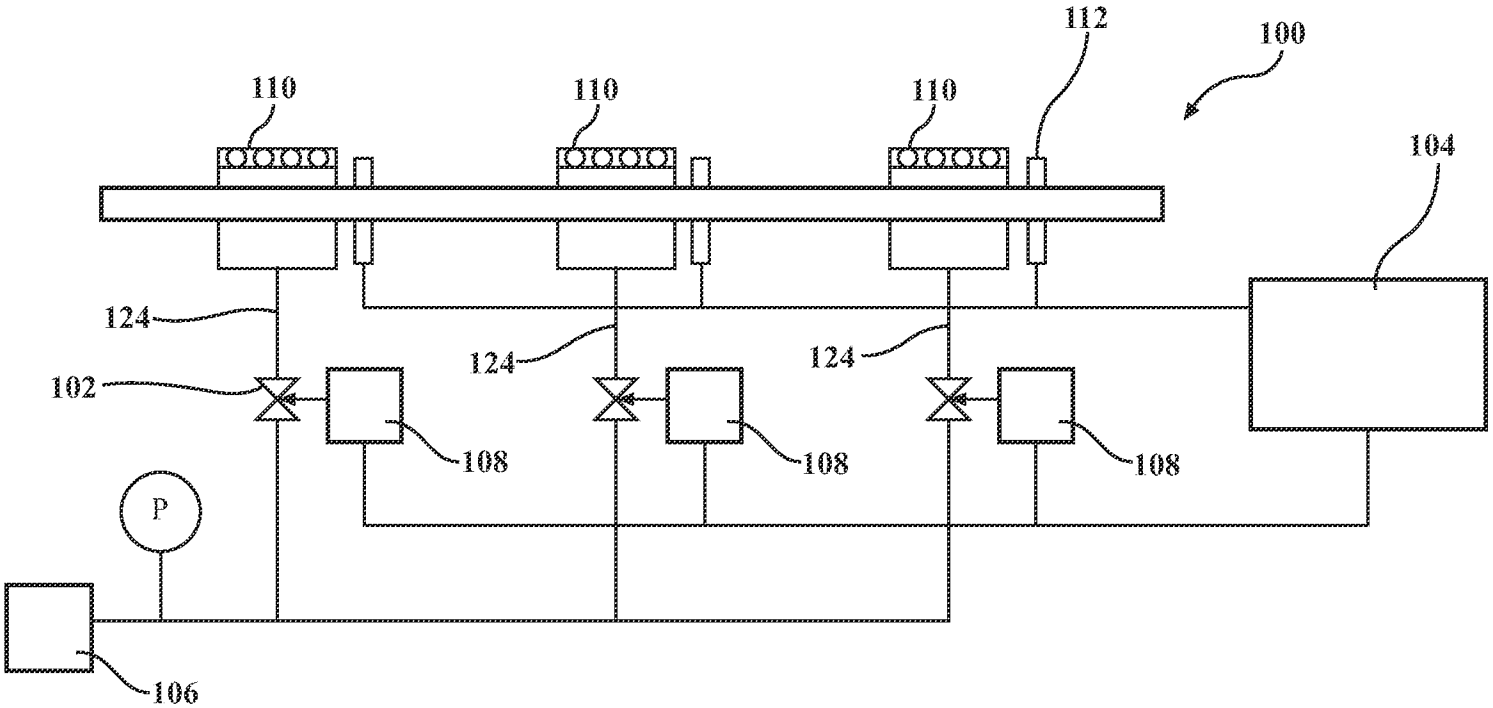
FIG. 1 is a cooktop system diagram in accordance with an embodiment of the present disclosure.

Described below are examples of cooktop burner systems that comprise hot surface igniters for igniting cooking gas. The hot surface igniter comprises a ceramic body having an embedded conductive ink circuit. A portion of the conductive ink circuit comprises a resistive heat generating section that generates heat when connected to a power source.

In certain examples, the burner systems of the present disclosure comprise a hot surface igniter having a ceramic body with a length defining a length axis, a width defining a width axis, and a thickness defining a thickness axis. The igniter comprises first and second ceramic tiles having respective outer surfaces. A conductive ink pattern is disposed between the first and second ceramic tiles. The igniter has a thickness along the thickness axis of less than 0.04 inches, and when subjected to a potential difference of 120V AC rms, the igniter reaches a temperature of at least 1400° F. in no more than four seconds. Unless otherwise specified herein, all AC voltages are rms voltages.

The hot surface igniters described herein are generally in the shape of a rectangular cube and include two major facets, two minor facets, a top and a bottom. The major facets are defined by the first (length) and second (width) longest dimensions of the ceramic igniter body. The minor facets are defined by the first (length) and third (thickness) longest dimensions of the igniter body. The igniter bodies also include a top surface and a bottom surface which are defined by the second (width) and third (thickness) longest dimensions of the igniter body.

The igniter tiles are ceramic and preferably comprise silicon nitride. The conductive ink circuit is disposed between the tiles and generates heat when energized. The ceramic tiles are electrically insulating but sufficiently thermally conductive to reach the outer surface temperature necessary to ignite cooking gas such as natural gas, propane, butane, and butane 1400 (a butane and air mixture with a heating value of 1400 Btu/ft$^3$) within the desired period of time.

In certain examples, the ceramic tiles comprise silicon nitride, ytterbium oxide, and molybdenum disilicide. In the same or other examples, the conductive ink circuit comprises tungsten carbide, and in certain specific implementations, the conductive ink additionally comprises ytterbium oxide, silicon nitride, and silicon carbide. However, in a preferred implementation, the conductive ink comprises no more than 0.00 percent ytterbium oxide by weight of the conductive ink, and in a more preferred implementation the conductive ink comprises no more than 0.00 percent rare earth oxides by weight. It has been found that substantially or completely eliminating ytterbium oxide concentrations below this level adds significantly to the cycle life of the hot surface igniter. In certain examples, hot surface igniters herein which comprise a conductive ink that includes silicon nitride and tungsten carbide—but less than 0.00 percent by weight of ytterbium oxide—achieve a cycle life of at least about 90,000 cycles, preferably at least about 100,000 cycles, and more preferably, at least about 120,000 cycles at 120V AC. As used herein, the term "cycle life" refers to a test wherein a hot surface igniter is successively energized for 30 seconds and de-energized for 30 seconds until failure.

Thus, each cycle lasts 60 seconds long. An igniter's "on time" is the total amount of time the igniter is energized in order to ignite over its cycle life. In many cooktop applications, the igniter on time is 20,000 seconds. However, in certain examples, hot surface igniters herein which comprise a conductive ink that includes silicon nitride and tungsten carbide—but less than 0.00 percent by weight of ytterbium oxide—achieve an igniter on time of at least 2.7 million seconds, preferably 3.0 million seconds, and more preferably, 3.6 million seconds. Thus, the substantial or complete elimination of ytterbium oxide is believed to yield an improvement in igniter on time of two orders of magnitude. In the same or other examples, the amount of silicon nitride in the conductive ink is from about 25 percent to about 40 percent, preferably from about 28 percent to about 37 percent, and more preferably from about 30 to about 33 percent by weight of the ink. In the same or other examples, the amount of tungsten carbide present in the conductive ink by weight of the conductive ink is preferably from about 60 percent to about 80 percent by weight, more preferably from about 65 percent to about 75 percent by weight, and still more preferably from about 67 percent to about 70 percent by weight.

In certain examples of cooktop applications, when subjected to a potential difference of 120V AC, the hot surface igniters described herein reach a surface temperature of at least 1400° F., preferably no less than 1800° F., more preferably no less than 2100° F., and even more preferably no less than 2130° F. in no more than four seconds after the potential difference is applied. These temperatures are preferably reached in no more than three seconds, more preferably reached in no more than two seconds, and still more preferably, reached in no more than one second.

In the same or additional examples, the surface temperature of the hot surface igniters herein does not exceed 2600° F., preferably does not exceed 2550° F., more preferably does not exceed 2500° F., and still more preferably 2450° F. at any time after the full wave 120V AC potential difference is applied, including after a steady-state temperature is reached.

In the same or other examples of hot surface igniters in accordance with the present disclosure, when subjected to a potential difference of 102V AC, the hot surface igniters described herein reach a surface temperature of at least 1400° F., preferably at least 1800° F., and still more preferably at least 2100° F. in no more than five seconds after the 102V AC potential difference is first applied. These temperatures are preferably reached in no more than four seconds, and more preferably reached in no more than three seconds.

In the same or additional examples, the thickness of the igniter body is not more than about 0.040 inches, preferably not more than about 0.035 inches, and still more preferably not more than about 0.030 inches. In the same or other examples, the thickness of the igniter body is at least about 0.02 inches, preferably at least about 0.024 inches, and more preferably at least about 0.026 inches.

In the same or additional examples, the thickness of the conductive ink circuit of the hot surface igniter (taken along the thickness axis) is not more than about 0.002 inches, preferably not more than about 0.0015 inches, and more preferably, not more than about 0.0009 inches. In the same or additional examples, the thickness of the conductive ink circuit (taken along the thickness axis) is not less than about 0.00035 inches, preferably not less than about 0.0003 inches, and more preferably, no less than about 0.0004 inches.

In the same or other examples, the conductive ink comprises silicon nitride and tungsten carbide. In preferred examples, the conductive ink comprises no more than 0.00 percent ytterbium oxide ($Yb_2O_3$) by weight of the conductive ink. In the same or other preferred examples, the conductive ink comprises no more than 0.00 percent rare earth oxides.

The hot surface igniters of the present disclosure also preferably have a green body density of at least 50 percent of theoretical density, more preferably, at least 55 percent, and still more preferably at least 60 percent of theoretical density.

Referring to FIG. 1, a cooktop system 100 comprising a plurality of burners 110 is depicted. Controller 104 is operationally coupled to user controls, for example, knobs corresponding to each burner 110 which is depressible and rotatable. Controller 104 is operatively coupled to actuators 108 which are independently and selectively operable to open and shut gas valves 102 to each of three burners 110. Cooking gas supply source 106 supplies cooking gas to each burner 110 at a source pressure (indicated with a "P" in a circle) and total mass flow rate that is based on the positions of the user knobs (not shown). Downstream of the pressure indicator shown in FIG. 1, a pressure regulator is preferably provided to provide high pressure protection to the burners 110. In the case of an excessive supply pressure, the regulator provides additional pressure drop to avoid over pressuring the burners 110. The pressure regulator is preferably set based on the type of cooking gas used, and in certain cases, burner design standards exist which are based on specified regulator pressures, as illustrated in Table 3 below.

Each burner 110 includes a respective hot surface igniter 112. Although not depicted in FIG. 1, in preferred examples described below, each hot surface igniter is located in a recess in the burner crown to protect the igniter from user damage and to aid in pooling combustion gas to create a combustible mixture for ignition.

Each hot surface igniter 112 is selectively energizable to heat its respective outer surface to a temperature above the auto-ignition temperature of the cooking gas and cause ignition when the percentage of oxygen and cooking gas proximate the igniter 112 is between the lower explosive limit (LEL) and upper explosive limit (UEL). Controller 104 is operable to selectively energize each igniter 112 based on the position of the knob corresponding to that igniter 112 and its burner 110. The knobs are preferably manipulable in at least two dimensions to both adjust a state of energization of the respective igniter 112 and a flow rate of cooking gas to the respective burner 110. In one example, each knob can depressed along a central axis and rotated about the central axis to define three energization states for the knob's respective igniter 112 and a variety of gas flow rates to the corresponding burner 110. In one example, during ignition or cooking, the rotation of the knob opens and closes its respective cooking gas valve 102. Controller 104 may include or be operatively connected to igniter energization circuits such as those shown in FIGS. 5A-5C (discussed below) to adjust the position of switches that dictate the igniter 112 energization state, as explained further below. In certain examples, a control valve downstream of cooking gas supply 106 but before the pressure indicator may be used to shut of the gas flow to all three burners 110 if a current sensor or flame detector indicates that one or more of the igniters 112 has failed to ignite. One of the benefits of using hot surface igniters as compared to spark igniters is the lack of the audible "click" generated during spark ignition. However, some users may be accustomed to the clicking sound. Thus, in certain examples, controller 104 may be operatively connected to a sound generator and may cause the generator to emit an audible indication that the igniter 112 has been energized.

Figure 2A:
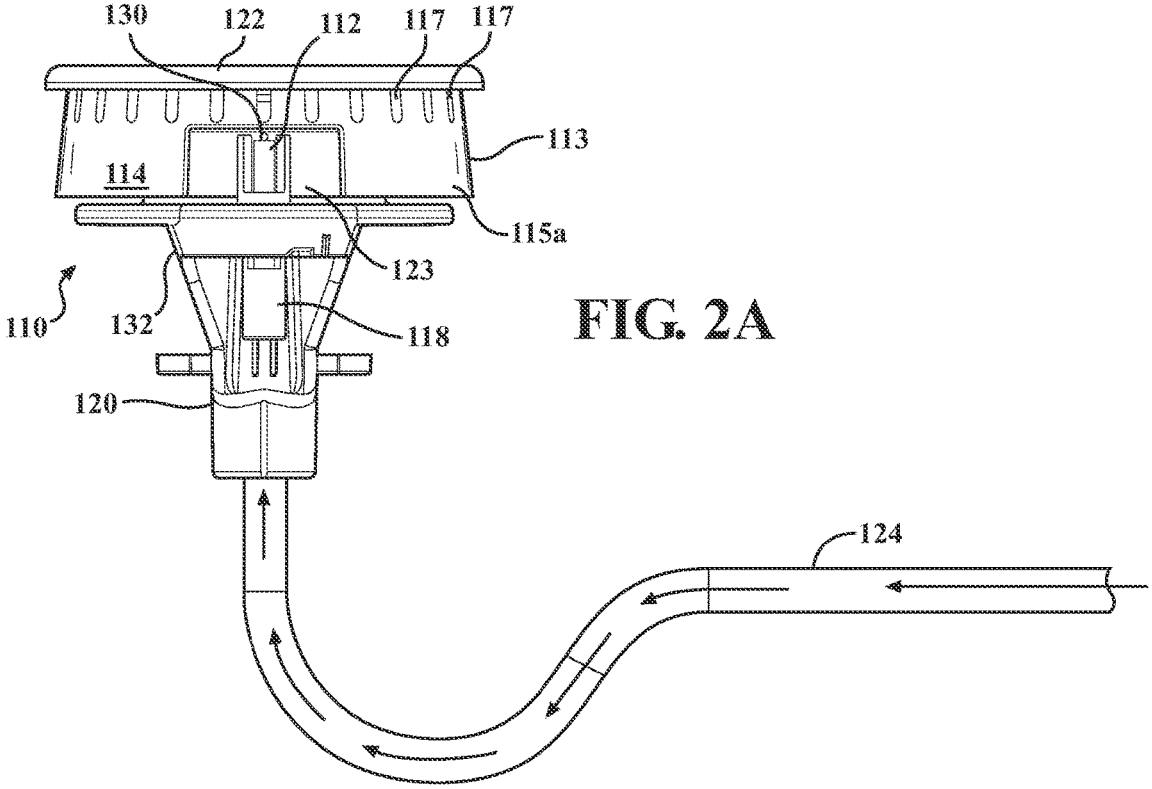
FIG. 2A is a side elevational view taken from a first side of a burner system including a portion of the cooking gas supply system.
Figure 2B:
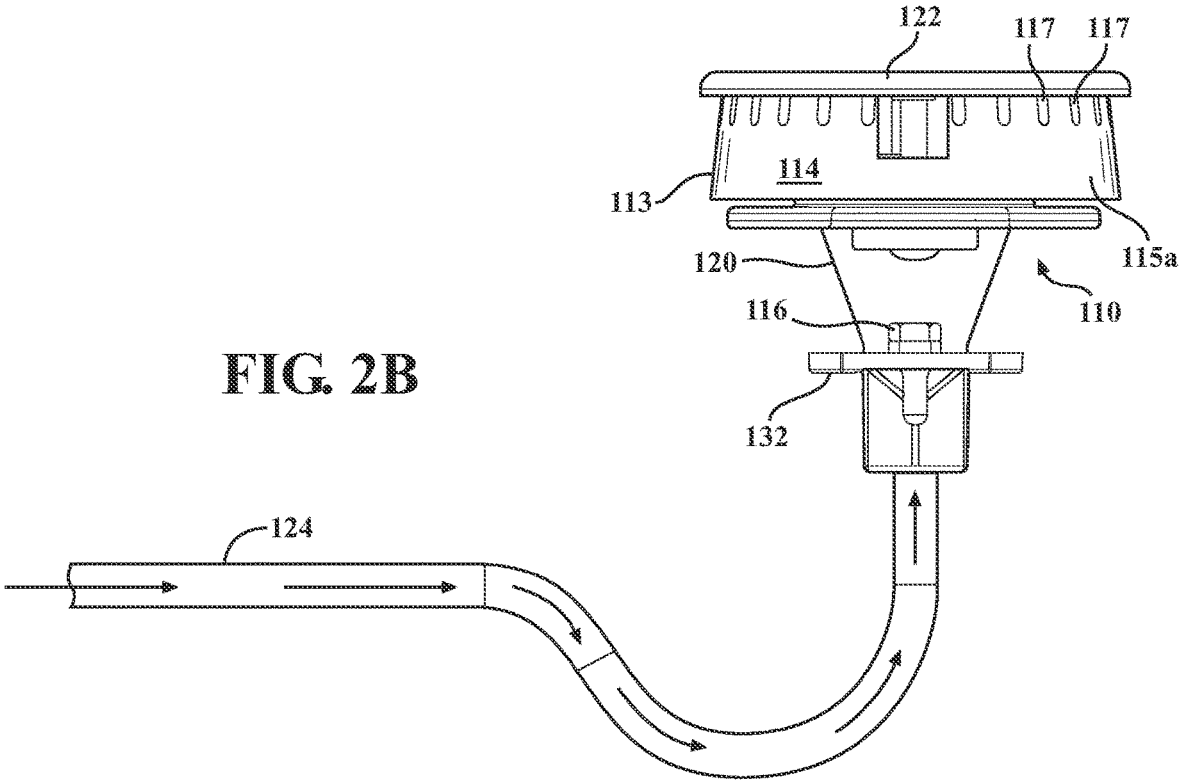
FIG. 2B is a side elevational view of the burner system of FIG. 2A taken from the opposite side of the view of FIG. 2A.
Figure 2C:
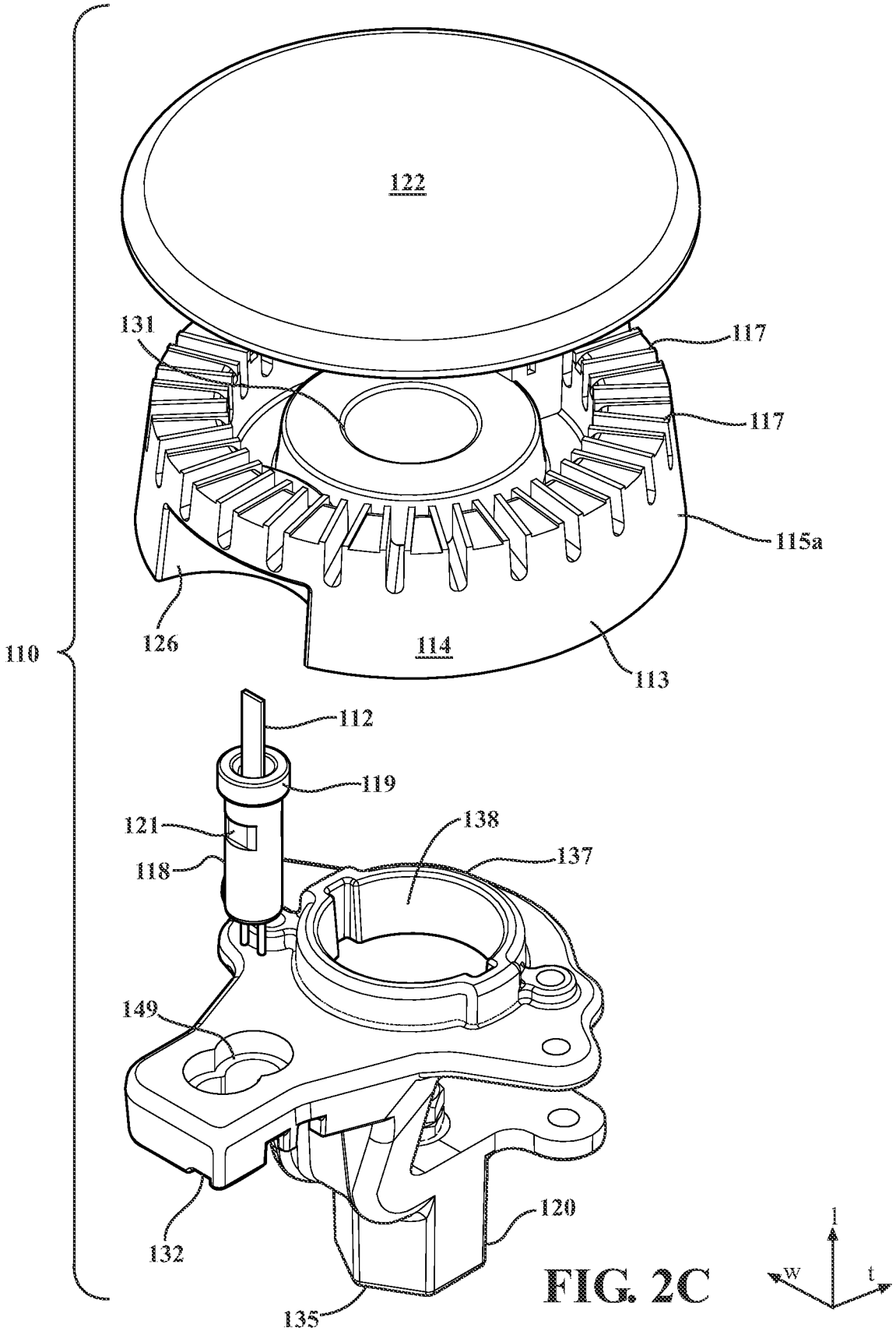
FIG. 2C is an exploded view of a first exemplary burner assembly comprising a hot surface igniter, an insulator and a crown recess for housing a hot surface igniter.

Referring to FIGS. 2A-2C, a close-up view of one of the burners 110 from FIG. 1 is shown. FIG. 2A is a view of burner 110 from the side of the burner on which the hot surface igniter 112 is located. The gas line 124 downstream of the burner valve 102 is also shown.

Figure 2D:
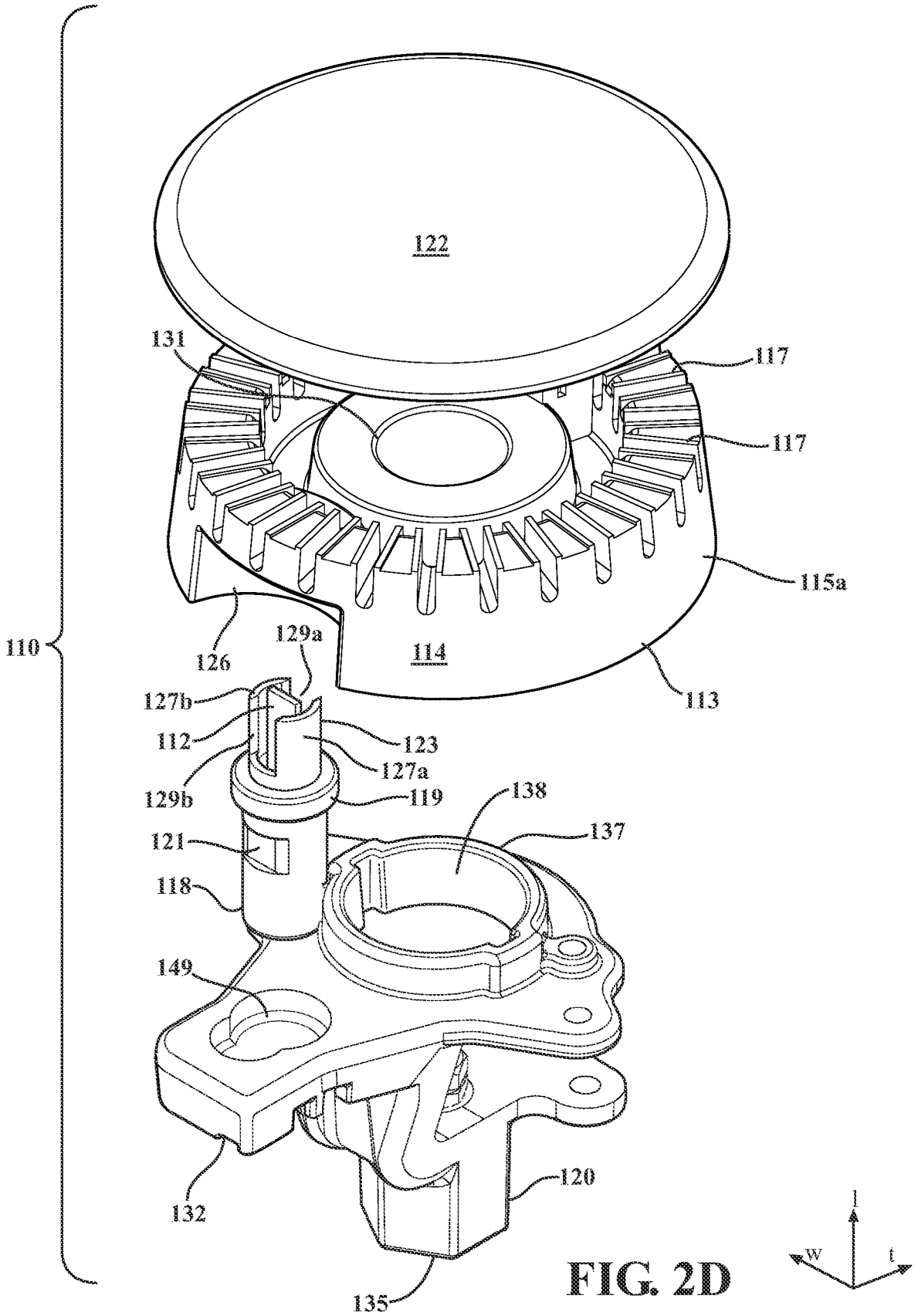
FIG. 2D is an exploded view of a second exemplary burner assembly comprising a hot surface igniter, an insulator and a protective enclosure extending therefrom for protecting the distal end of the hot surface igniter.
Figure 2E:
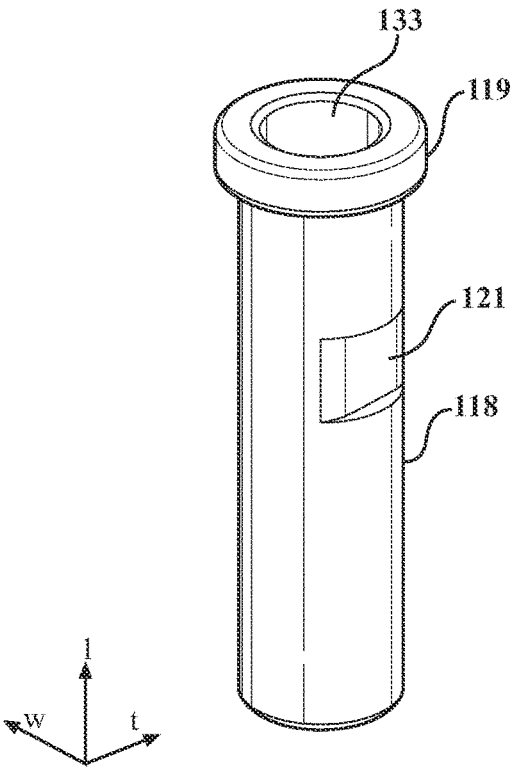
FIG. 2E is a perspective view of the insulator of FIG. 2C.
Figure 2F:
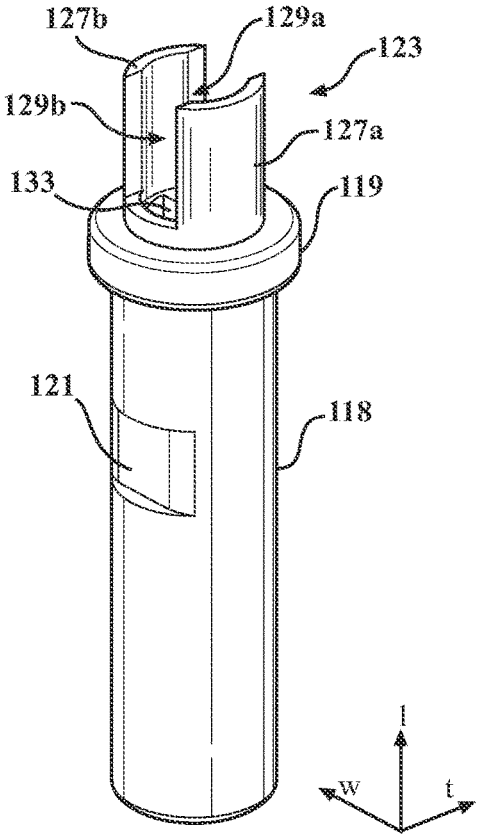
FIG. 2F is a perspective view of the insulator and distal protective enclosure of FIG. 2D.
Figure 2G:
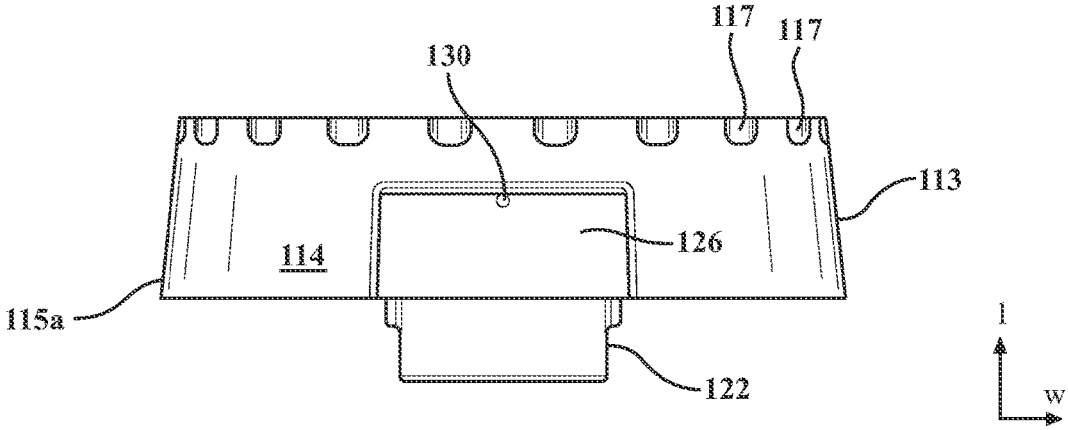
FIG. 2G is a side elevational view of the burner crown of FIGS. 2C and 2D.

As shown more specifically in FIG. 2G, burner 110 includes a crown 113 which is a disk shaped, rigid structure having a flange 114 extending along the burner's central axis. The flange 114 comprises an outer surface 115*a* and an inner surface 115*b* (not visible). A plurality of flutes 117 are arranged around the perimeter of the flange 114. The flutes are orifices extending from the inner surface 115*b* of the flange radially to the outer surface 115*a*. Central opening 131 receives cooking gas from a source of cooking gas, and burner lid 122 directs the gas through flutes 117. Axially downward-extending flange 122 is provided and includes an opening (not shown) that is in fluid communication with central opening 131. As shown in FIGS. 2B, gas from supply line 124 enters gas inlet port 135 and exits gas orifice 116. A connecting tube (not shown) connects orifice 116 with orifice holder central opening 138, which in turn allows cooking gas to flow into the burner crown 113 via central opening 131.

Orifice holder 120 connects burner crown 113 to a source of cooking gas and holds the crown in place within the cooktop. Orifice holder 120 includes an igniter holder 132, a gas inlet port 135, and an axially-upward extending flange 137 that defines a central opening 138. The axially-downward extending flange 122 of burner crown 113 cooperatively engages the axially-upward extending flange 122 of burner crown 113 so that the central opening 131 of the burner crown is co-axial with and in fluid communication with the orifice holder central opening 138. Cooking gas supply line 124 (FIG. 2B) connects to the orifice holder gas inlet port 135.

Referring to FIGS. 2C and 2D, a ceramic insulator 118 houses a portion of the length of hot surface igniter 112, such that a distal section of igniter 112 projects away from insulator 118 along the length axis of the insulator 118. Insulator 118 is generally cylindrical and is open at the top with a collar 119 circumscribing the top opening 133. In the example of FIGS. 2C and 2E, the distal section of igniter 112 simply projects away from collar 119 along the insulator's length axis without any further structure or enclosure. Orifice holder 120 includes an igniter holder 132 which has an insulator bore 149 into which ceramic insulator 118 is inserted. The entirety of the hot surface igniter's resistive heat circuit and heating zone (described below) preferably projects away from the insulator 118. In FIGS. 2C and 2E, the positioning of the insulator 118 and igniter 112 within crown recess 126 protects the igniter 112 from damage by users during cleaning or other activities. Insulator 118 may also include flats 121 (a corresponding flat on the other side of the insulator 118 is not shown) which engage a retaining clip in the igniter holder 132.

In some cases, it may be desirable to further enclose and protect the distal portion of igniter 112 that projects axially away from the insulator 118. As shown in FIG. 2F, a protective enclosure 123 is provided and is attached to the distal end of insulator 118 at collar 119. Protective enclosure 123 may be formed integrally with insulator 118 or may be formed separately and attached to insulator 118. Protective enclosure 123 preferably extends beyond the distal most end of igniter 112 and includes open areas 129*a* and 129*b* around the distal end of the igniter 112 which allow cooking gas to pass through to the surface of igniter 112. The protective enclosure of FIG. 2F comprises two partially cylindrical posts 127*a* and 127*b* which are in facing opposition to one another and which define openings 129*a* and 129*b* which are also in facing opposition to one another. When insulator 118 is installed in orifice holder 132, one of the openings 129*a*, 129*b* is preferably positioned so that igniter port 130 has a direct line of sight to a surface of igniter 112. In certain examples, one surface of igniter 112 (preferably a major surface) faces igniter port 130 so that a line perpendicular to the igniter 112 surface intersects igniter port 130 without being blocked by an portion of the insulator 118 or protective enclosure 123. The protective enclosure 123 is also preferably an insulating material such as a ceramic. A variety of insulator and protective enclosure structures suitable for use with burners 110 are shown in FIGS. 1A-7E of U.S. Provisional Patent Application No. 62/648,574, which is incorporated by reference herein. In addition to protecting igniter 112 from damage, both crown recess 126 and protective enclosure 123 have the effect of "pooling" combustion gas to allow the area proximate the surface of the distal portion of igniter 112 which helps in more quickly creating a combustible mixture of air and gas (i.e., a mixture having a composition that falls between the lower and upper explosive limits) proximate the surface of igniter 112. Thus, both collar 119 and protective enclosure 123 achieve the unexpected benefit of facilitating and/or expediting combustion.

The portion of the cooking gas supply line 124 shown in FIG. 2A is downstream of cooking gas valve 102 in FIG. 1. Cooking gas flows through supply line 124, into gas orifice holder 120 and out of gas orifice 116. The burner 110 of FIGS. 2A-2G is a "bottom breather" in that it draws ambient air in from the bottom of the crown 113. As mentioned previously, a connecting tube (not shown) connects the gas orifice 116 to the interior of the crown 113 via axially-downward extending flange 119 (FIG. 2G). The connecting tube is narrow in the middle and wide at the ends. Air holes are present in the connecting tube downstream of the narrow section, and as the pressure drops due to the flow of gas through the narrowed section, the internal pressure drop sucks in atmospheric air to provide the required air/gas mixture for combustion. In addition to bottom breathing burners 110, top breathing burners may be used. In a top breathing burner, ambient air does not enter the bottom of the crown with the cooking gas. Instead, the combustible air gas mixture is formed immediately outside of the flutes 117. In both top and bottom breathing burners, combustion occurs immediately outside the flutes 117.

Hot surface igniter 112 projects into an igniter recess 126 within crown 113. Leads (not shown) electrically connect the igniter 112 to an igniter circuit operatively connected to controller 104. Igniter gas port 130 (FIG. 2G) places the igniter 112 in fluid communication with the interior of the crown 113 so that cooking gas from supply line 124 can be provided to igniter 112. When igniter 112 is energized to an ignition voltage, its outer surface reaches a temperature greater than the auto-ignition temperature of the cooking gas. When a combustible mixture of air and cooking gas reaches the hot surface igniter 112 while the igniter surface is at or above the auto-ignition temperature, the cooking gas will ignite, causing the cooking gas outside of the igniter flutes 117 to ignite and to remain ignited. The auto-ignition temperatures of various cooking gases are as follows:

TABLE I

| Cooking Gas | Auto-ignition Temp (° C.) | Auto-ignition Temp (° F.) |
|---|---|---|
| Methane (natural gas) | 580 | 1076 |
| n-Butane | 405 | 761 |
| Propane | 480 | 842 |

In order for ignition to occur, the mixture of air and cooking gas proximate hot surface igniter 112 must be between the lower explosive limit/lower flammable limit (LEL/LFL) and upper explosive limit/upper flammable limit (UEL/UFL) for the cooking gas. Provided in Table 2 are the LEL and UEL values as percent by volume of air:

| Cooking Gas | LEL/LFL (% by vol of air) | UEL/UFL (% by vol of air) |
|---|---|---|
| n-Butane | 1.86 | 8.41 |
| iso-Butane | 1.80 | 8.44 |
| Methane (natural gas) | 4.4 | 16.4 |
| Propane | 2.1 | 10.1 |

As mentioned previously, in certain cases, it may be desirable to provide a burner system in which the burner gas flow during ignition or re-ignition is not the highest gas flow setting, which is often the case, but rather, a lower gas flow setting such as "simmer." Known cooktops ignite at a relatively high gas flow rate to ensure that a combustible mixture of air and cooking gas is present at the spark igniter during ignition. However, it wastes gas, can create an unanticipated gas ignition plume or can fill a room with unignited gas, and thus, create an undesirable indoor environment. When cooking at a low gas flow rate, as the flow rate decreases at the burners 110, the gas valves 102 (FIG. 1) will throttle back and reduce the total gas flow in the crown gas supply lines 124. The gas entering the crowns 113 will have two competing flow paths out of the crowns 113: out of the crown flutes 117 or out of the igniter recess orifice 130 (FIG. 2G). Because of their number and area relative to the area of igniter recess orifice 130, flutes 117 will receive more total cooking gas flow than the igniter orifice 130. As the supply pressure P drops (FIG. 1) upstream of the gas valves 102, eventually the flow rate of cooking gas to the igniter 112 will be insufficient to reach the LEL/LFL. Moreover, ANSI Z211.1-2016 requires satisfying the four second ignition requirement described previously at three cooking gas supply pressures: reduced, normally, and increased. However, if the burner flow rate is to be maintained at a low level (such as in a simmer mode), the gas valves 102 must be throttled, which increases their respective pressure drops and ultimately may provide insufficient pressure to supply the igniter 112 with enough cooking gas to keep the region proximate the igniter above the LEL/LFL. Table 3 lists the cooking gas supply pressures P from ANSI Z211.1-2016 at which the four second ignition requirement must be satisfied for a variety of cooking gases.

TABLE 3

| Cooking Gas | Reduced Pressure (in. $H_2O$/kPa) | Normal Pressure (in. $H_2O$/kPa) | Increased Pressure (in. $H_2O$/kPa) |
|---|---|---|---|
| Methane (Natural Gas) | 3.5 (0.87) | 7.0 (1.74) | 10.5 (2.61) |
| n-Butane | 8.0 (1.99) | 11.0 (2.74) | 13.0 (3.23) |

TABLE 3-continued

| Cooking Gas | Reduced Pressure (in. $H_2O$/kPa) | Normal Pressure (in. $H_2O$/kPa) | Increased Pressure (in. $H_2O$/kPa) |
|---|---|---|---|
| Propane HD-5 | 8.0(1.99) | 11.0(2.74) | 13.0(3.23) |
| Butane 1400 (Butane/Air) | 3.5(0.87) | 7.0(1.74) | 10.5(2.61) |

In accordance with certain embodiments, the number and opening area of burner flutes 117 and the area of igniter orifice 130 for each burner 110 are sized such that when the supply pressure P (FIG. 1) is at 8.0 inches of water, and methane or butane 1400 is used as the cooking gas, the total gas flow rate to each burner 110 through each supply line 124 is no more than 1.8 L/min, preferably not more than 1.0 L/min, and even more preferably no more than 0.2 L/min. At the same time, the gas flow rate to the corresponding igniter 112 (through igniter orifice 130) is at least $9.9\times10^{-3}$ L/min, preferably at least 0.05 L/min, and more preferably at least 0.09 L/min to reliably ensure ignition by hot surface igniters 112. In the same or other embodiments, the number and opening area of burner flutes 117 and the area of igniter orifice 130 for each burner 110 are sized such that when the supply pressure P (FIG. 1) is at 8.0 inches of water, and n-Butane or Propane HD-5 is used as the cooking gas, the total gas flow rate to each burner 110 through each supply line 124 is no more than 2.7 L/min, preferably no more than 1.5 L/min, and even more preferably no more than 0.32 L/min. At the same time, the gas flow rate to the corresponding igniter 112 (through igniter orifice 130) is at least 0.016 L/min, preferably at least 0.08 L/min, and more preferably at least 0.14 L/min to reliably ensure ignition by hot surface igniters 112. In preferred examples of burner systems herein, at the foregoing conditions a combustible mixture (i.e., one between the upper and lower explosive limits) is provided at the igniter 112, and igniter 112 can ignite the mixture of air and cooking gas in no more than four seconds.

Figure 5A:
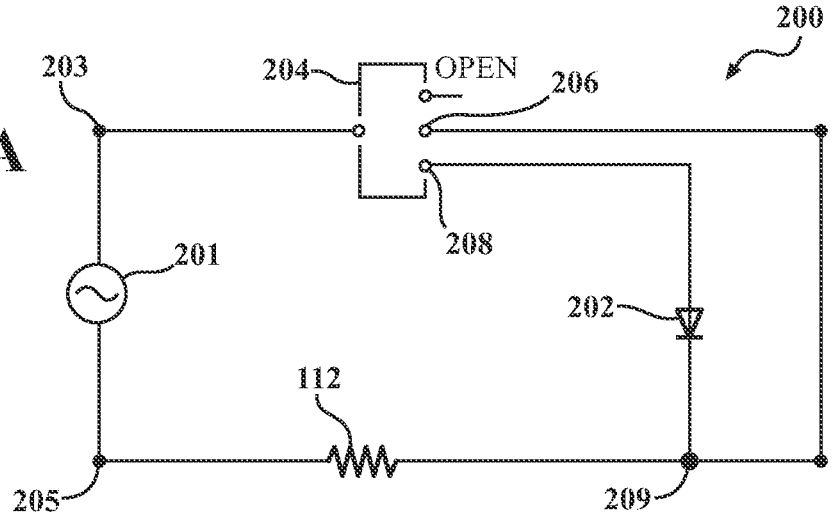
FIG. 5A is a first example of a hot surface igniter circuit in accordance with the present disclosure.
Figure 5B:
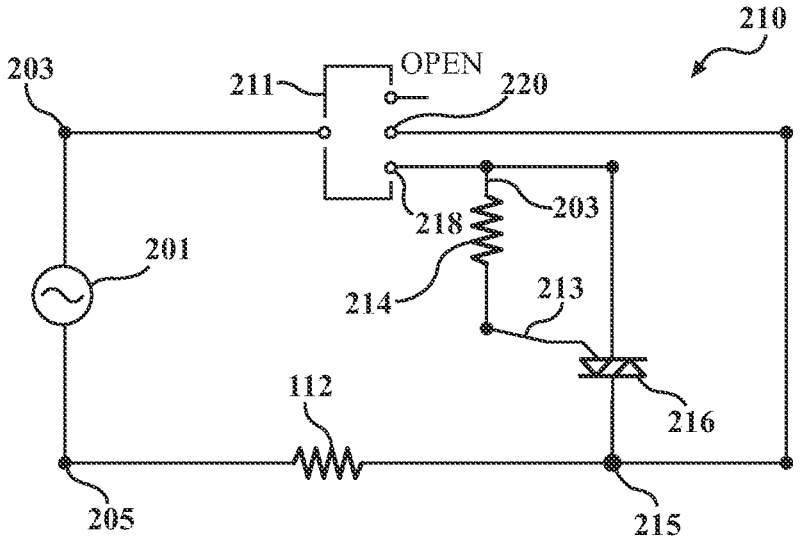
FIG. 5B is a second example of a hot surface igniter circuit in accordance with the present disclosure.
Figure 5C:
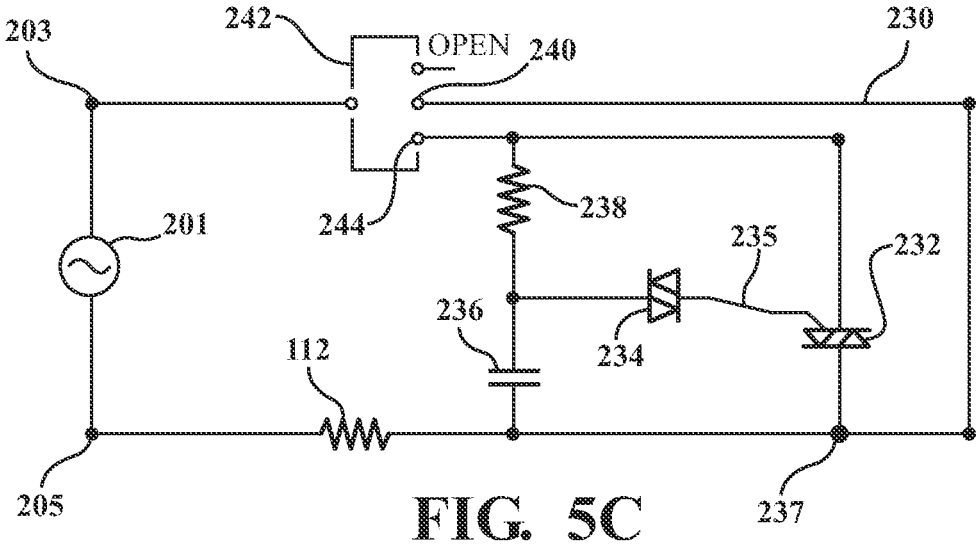
FIG. 5C is a third example of a hot surface igniter circuit in accordance with the present disclosure.

In certain examples, a flame sensor is provided which detects when the cooking gas within the crown 113 has ignited, and the flame sensor provides a signal to controller 104 indicating the presence or absence of a flame. In one example, if a flame is sensed, controller 104 sends a signal to the igniter's igniter circuit, and the hot surface igniter 112 is de-energized. In another example, if the igniter remains energized for more than a desired period without a flame being sensed, controller 104 sends a signal to the actuator 108 to shut gas valve 102, and the gas flow to the burner 110 is discontinued. In a further example, if a flame is sensed, the power supplied to the igniter 112 is reduced to lower the surface temperature of the igniter relative to its surface temperature during ignition while still maintaining it above the auto-ignition temperature of the cooking gas. Discussed below with respect to FIGS. 5A-5C are igniter circuits which keep the igniter 112 energized following ignition at a power level that is less than the initial ignition power level yet sufficient to maintain the igniter surface at a temperature above the auto-ignition temperature for the particular cooking gas.

In another example, flame sensors are not used. Instead, the user control (e.g., a knob) is manipulable to indicate that ignition is desired (e.g., pushed inward along the knob's central axis), and when the manipulation is discontinued (e.g., the knob is released), the hot surface igniter is de-energized or energized at a power level lower than the initial ignition power level. "Initial" ignition occurs when ignition is initiated after the cooking gas valve 102 is shut, and in certain embodiments, initial ignition occurs at a higher power level than "re-ignition" which occurs when there is a flame out causing an interruption in the supply of cooking gas to the igniter despite the cooking gas valve 102 being open.

Figure 3A:
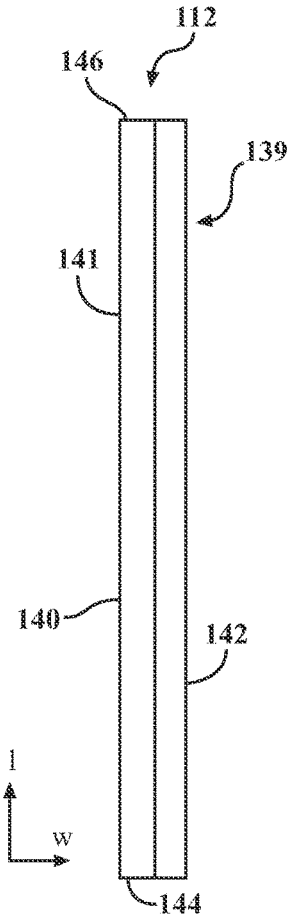
FIG. 3A is a side view of an exemplary hot surface igniter for use in the burner assemblies described herein.
Figure 3B:
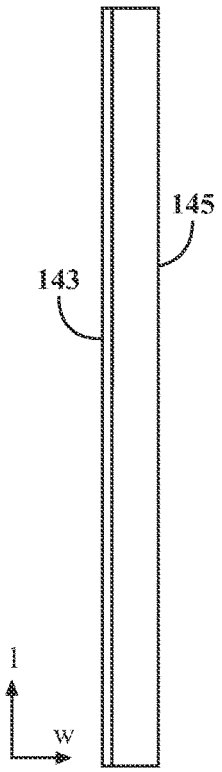
FIG. 3B is a modified example of the hot surface igniter of FIG. 3A in which the ceramic tiles have different thicknesses.
Figure 3C:
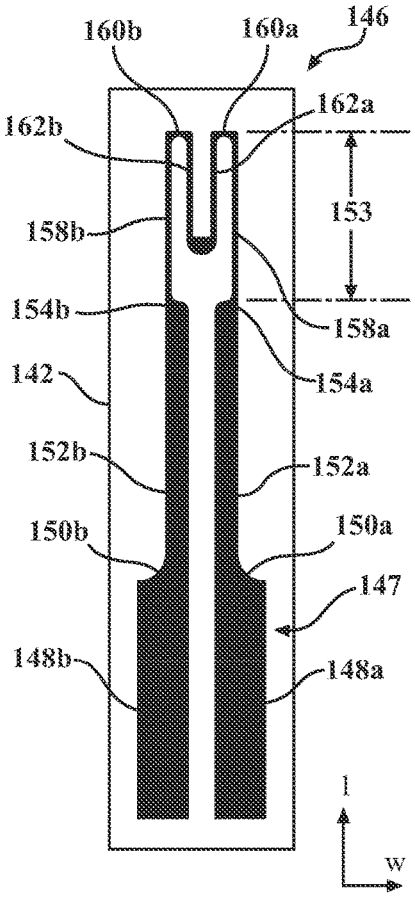
FIG. 3C is a top plan view of a cross-section of a "thin nitride, long" (TNL) hot surface igniter in accordance with the present disclosure as viewed along the igniter thickness axis t in which the distal ends of the conductive ink heating zone leg connectors are flat.

Referring to FIGS. 3A-H examples of hot surface igniter 112 are depicted. As shown in FIGS. 3A and 3C, hot surface igniter 112 comprises a ceramic body 139 having a proximal end 144 and a distal end 146 spaced apart along an igniter length axis 1. Ceramic body 139 also has a width axis w and a thickness axis t. The length/axis corresponds to the longest dimension of the ceramic body 139. The width w axis corresponds to the second longest dimension of ceramic body 139, and the thickness t axis corresponds to the third longest (or shortest) dimension of ceramic body 139. Igniter 112 length is at least 1.7 inches, preferably at least 1.8 inches, and more preferably at least 1.9 inches. At the same time, igniter 112 length is no more than 2.2 inches, preferably no more than 2.1 inches, and still more preferably no more than 2.0 inches. Igniter 112 width along the width axis is from 0.160 to 0.210 inches, preferably from 0.170 to 0.200 inches, and more preferably from 0.180 to 0.190 inches.

Ceramic body 139 comprises two ceramic tiles 140 and 142 with an embedded conductive ink circuit 147 of the type described previously. The ceramic tiles 140, 142 preferably comprise silicon nitride, and more preferably comprise silicon nitride, ytterbium oxide, and molybdenum disilicide. The igniter 112 also includes connectors 148*a* and 148*b* which project away from distal end 146 in the proximal direction along the igniter length axis 1. External leads 134 and 136 (not shown) are attached to ceramic body 139 and are connected to the connectors 148*a* and 148*b*, respectively.

In certain examples of cooktop burner systems, in order to meet the igniter's time to temperature requirement, the igniter body 139 must be thinner than many conventional igniters along the thickness axis t. Igniter 112 preferably has a thickness along the thickness axis t of less than 0.04 inches, preferably less than 0.035 inches, and more preferably less than 0.030 inches. In the same or other examples, the thickness of the igniter body along the thickness axis t is at least about 0.02 inches, preferably at least about 0.024 inches, and more preferably at least about 0.026 inches.

In the same or additional examples, the thickness of the conductive ink circuit 147 of the hot surface igniter 112 along the thickness axis t is not more than about 0.002 inches, preferably not more than about 0.0015 inches, and more preferably, not more than about 0.0009 inches. In the same or additional examples, the thickness of the conductive ink circuit 147 along the thickness axis t is not less than about 0.0006 inches, preferably not less than about 0.0005 inches, and more preferably, no less than about 0.0004 inches.

Hot surface igniter 112 has the required structural integrity to survive the burner environment while having the foregoing thickness. A useful test of structural integrity is the flexural strength. Flexural strength is the stress at fracture during a bending test. It is also called bend strength or modulus of rupture. It represents the maximum tensile stress that can be applied to deform or fracture an element. Ceramic materials are generally weak in tension, so tensile stress is one of the major indicators for mechanical strength. The higher the flexural strength, the more "difficult" to bend or break the material. Hot surface igniter 112 has a flexural strength of at least 400 MPa, preferably at least 425 MPa, and more preferably at least 450 MPa when tested in accordance with ASTM C-1161. At the same time, the igniter 112 has a flexural strength of no more than 600 MPa, preferably no more than 575 MPa, and still more preferably no more than 550 MPa when tested in accordance with ASTM C-1161. Without wishing to be bound by any theory, it is believed that forming the green igniter tiles with a green body density of at least about 45 percent of theoretical density, preferably at least about 55 percent of theoretical density, and more preferably of at least about 60 percent of theoretical density allows the igniter 112 to have the foregoing combination of flexural strength and thinness, the latter of which facilitates significant improvements in time to temperature values.

Post-sintering, the tiles 140 and 142 (not including conductive ink circuit 147) have a room temperature resistivity that is no less than $10^{12}$ Ω-cm, preferably no less than $10^{13}$ Ω-cm, and more preferably, no less than $10^{14}$ Ω-cm. In the same or other examples, the tiles 140 and 142 have a thermal shock value in accordance with ASTM C-1525 of no less than 900° F., preferably no less than 950° F., and more preferably, no less than 1000° F.

The conductive ink comprising conductive ink circuit 147 has a (post-sintering) room temperature resistivity of from about $3.0\times10^{-4}$ Ω-cm to $1.2\times10^{-3}$ Ω-cm, preferably from about $3.5\times10^{-3}$ Ω-cm to about $1.0\times10^{-3}$ Ω-cm, and more preferably from about $4.3\times10^{-4}$ Ω-cm to about $8.7\times10^{-4}$ Ω-cm. In the case of a material with a constant cross-sectional area along its length, resistivity ρ at a given temperature T is related to resistance R at the same temperature Tin accordance with the well-known formula:

$$R(T)=\rho(T)(l/A), \text{ where} \tag{1}$$

ρ=resistivity of conductive circuit material (Ω-cm) at temperature T;

R=Resistance in ohms (Ω) at temperature T;

T=Temperature (° F. or ° C.);

A=cross-sectional area ($cm^2$) of conductive ink circuit perpendicular to the direction of current flow; and l=total length (cm) of the conductive ink circuit along the direction of current flow.

In the case of a cross-sectional area that varies along the length of the conductive circuit, the resistance may be represented as:

$$R = \rho(T)\int_0^L \frac{dl}{A} \tag{2}$$

where, L=total length of circuit along direction of current flow, and the remaining variables are as defined for equation (1).

Conductive ink circuit 147 is preferably printed onto the face of one of ceramic tiles 140, 142 to yield a (post-sintering) room temperature resistance (RTR) of from about 50Ω to about 150Ω, preferably from about 60Ω to about 120Ω, and more preferably from about 70Ω to about 110Ω. The conductive ink comprising conductive ink circuit 147 preferably comprises silicon nitride, and more preferably comprises silicon nitride and tungsten carbide. In the same or other examples, the conductive ink preferably comprises no more than 0.00 percent by weight ytterbium oxide ($Yb_2O_3$) and more preferably comprises no more than about 0.00 percent by weight of rare earth oxides. In the same or other examples, the amount of silicon nitride in the conductive ink is from about 25 percent to about 40 percent, preferably from about 28 percent to about 37 percent, and more preferably from about 30 to about 33 percent. In the same or other examples, the amount of tungsten carbide present in the conductive ink by weight of the conductive ink is preferably from about 60 percent to about 80 percent by weight, more preferably from about 65 percent to about 75 percent by weight, and still more preferably from about 67 percent to about 70 percent by weight. The igniter 112 of FIGS. 3A, 3C, and 3D has a cycle of at least about 90,000 cycles, preferably at least about 100,000 cycles, and more preferably at least about 120,000 cycles at 120 V AC. The igniter 112 of FIGS. 3A, 3C, and 3D also has an on time of at least 2.7 million seconds, preferably 3.0 million seconds, and more preferably 3.6 million seconds. As mentioned previously, without wishing to be bound by any theory, it is believed that the elimination of ytterbium oxide and other rare earth oxides is believed to result in significant improvements in cycle life and igniter on time.

When subjected to a potential difference of 120V AC, the outer surface 141 of hot surface igniter 112 reaches a surface temperature of at least 1400° F., preferably no less than 1800° F., more preferably no less than 2100° F., and even more preferably no less than 2130° F. in no more than four seconds after the potential difference is applied. Each of these temperatures is preferably reached in no more than three seconds, more preferably reached in no more than two seconds, and still more preferably, reached in no more than one second after the potential difference is first applied.

In the same or additional examples, when subjected to a potential difference of 120V AC, the temperature of the outer surface 141 of hot surface igniter 112 does not exceed 2600° F., preferably does not exceed 2550° F., more preferably does not exceed 2500° F., and still more preferably does not exceed 2450° F. at any time after the 120V AC potential difference is applied, including after a steady-state temperature is reached.

In the same or other examples of hot surface igniters in accordance with the present disclosure, when subjected to a potential difference of 102V AC, the hot surface igniters described herein reach a surface 141 temperature of at least 1400° F., preferably at least 1800° F., and still more preferably at least 2100° F. no less than 2050° F., preferably no less than 2080° F., and more preferably no less than 2130° F. in no more than five seconds after the 102V AC potential difference is applied. Each of these temperatures is preferably reached in no more than four seconds, and more preferably reached in no more than three seconds.

Figure 3D:
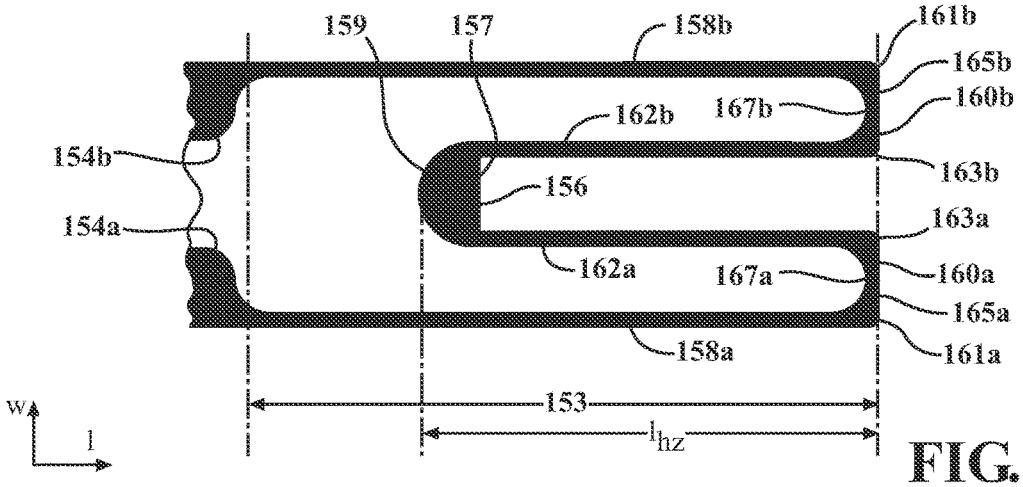
FIG. 3D is a top plan view of the distal end of the hot surface igniter conductive ink pattern of FIG. 3C.

For convenience, the hot surface igniter 112 of FIGS. 3A, and 3C-D will be referred to as a "thin nitride, long" or "TNL" igniter.

Referring to FIGS. 3A and 3B two alternate sintered hot surface igniter profiles are provided. In the symmetrical example of FIG. 3A, two ceramic tiles 140 and 142 are of equal thickness, and a conductive ink circuit is screen printed on one of the two facing surfaces of the tiles 140 and 142.

In the asymmetric example of FIG. 3B, ceramic tiles 143 and 145 are of different thicknesses. The thicker tile 145 provides greater structural integrity to the igniter 112. The thinner tile 143 provides a shorter path for heat conduction for the exposed major facet of ceramic body 139 and provides the "hot" surface that would preferably face the gas port 130 when the igniter is installed in a burner. In both cases (FIGS. 3A and 3B) the ceramic bodies preferably comprise silicon nitride and a rare earth oxide sintering aid, wherein the rare earth element is one or more of ytterbium, yttrium, scandium, and lanthanum. The sintering aids may be provided as co-dopants selected from the foregoing rare earth oxides and one or more of silica, alumina, and magnesia. A sintering aid protective agent is also preferably included which also enhances densification. A preferred sintering aid protective agent is molybdenum disilicide. The rare earth oxide sintering aid (with or without the co-dopant) is preferably present in an amount ranging from about 2 to about 15 percent by weight of the ceramic body, more preferably from about 8 to about 14 percent by weight, and still more preferably from about 12 to about 14 percent by weight. Molybdenum disilicide is preferably present in an amount ranging from about 3 to about 7 percent, more preferably from about 4 to about 7 percent, and still more preferably from about 5.5 to about 6.5 percent by weight of the ceramic body. The balance is silicon nitride.

In the case of the asymmetric example of FIG. 3B, the thinner tile 143 preferably has a thickness of no more than about 0.01 inches, more preferably no more than about 0.012 inches, and still more preferably no more than about 0.015 inches. In the same or additional examples, the thickness of the thicker tile 146 is preferably no more than about 0.04 inches, more preferably no more than about 0.02 inches, and still more preferably no more than about 0.018 inches.

Referring to FIG. 3C an example of a printed ink circuit 147 for use with the hot surface igniters described herein is depicted. The ink is preferably applied by screen printing to a major facet of one of the ceramic tiles 140, 142 before sintering. The conductive ink circuit comprises connectors 148*a* and 148*b* which are connected to external leads. Leads 152*a* and 152*b* are connected to the connectors 148*a* and 148*b*, respectively. The leads 152*a* and 152*b* are in turn connected to the resistive heating circuit 153 which comprises a conductive ink pattern configured to yield resistive heating when a potential difference is applied across connectors 148*a* and 148*db*. The resistive heating circuit is defined as beginning in where the proximal most end of legs 158*a* and 158*b* reach a substantially constant width along the width axis, just distal of the concave transitions 150*a* and 150*b* along the igniter length axis.

The resistive heating circuit 153 is shown in more detail in FIG. 3D. As shown in the figure, the resistive heating circuit comprises legs 158*a*, 158*b*, 162*a* and 162*b* which each have lengths along the igniter length axis/and widths along the igniter width axis w. The legs 158*a*, 158*b*, 162*a* and 162*b* are spaced apart along the igniter width axis w. The entire resistive heating circuit 153 preferably has a substantially constant thickness along the igniter thickness axis t.

The legs are connected by connections (or "connectors") 160*a*, 160*b*, and 156. At the connections 160*a*, 160*b*, and 156 the ink pattern changes direction from running parallel to the igniter length axis/to running parallel to the igniter width axis w. In certain cooktop applications, it has been found that utilizing a conductive ink width in the connections 160*a*, 160*b*, and 156 that is wider (along the length axis l) than the width of the conductive ink pattern in the legs 158*a*, 158*b*, 162*a* and 162*b* (along the width axis w) beneficially reduces the resistance in the connections 160*a*, 160*b*, and 156 and lowers the temperature in legs 162*a* and 162*b*, which in turn reduces the propensity for thermal degradation of the resistive heating circuit 153. In preferred examples, the connections 160*a*, 160*b*, and 156 include ink widths along the igniter length axis l that are double the width in the legs 158*a*, 1548*b*, 162*a* and 162*b* along the igniter width axis w.

Compared to many conventional conductive ink patterns, the leads 152*a* and 152*b* make a more abrupt transition to the resistive heating circuit 153. Referring to FIG. 3C, transition regions 154*a* and 154*b* are regions of diminishing ink width along the igniter width w axis when transitioning from leads

152*a* and 152*b* to legs 158*a* and 158*b*. In the example of FIG. 3C, the width of the igniter leads 152*a* and 152*b* along the igniter length width w varies along not more than 10 percent of the length of the leads 152*a* and 152*b* along the length axis l, starting with the end of terminal transition sections 150*a* and 150*b*, which are concave regions.

In addition to the ink width increase in the connections 160*a*, 160*b*, and 156, the connections preferably include corners 161*a* and 161*b* that are substantially right angles. In many conventional ink patterns, the ink pattern is rounded when transitioning from the legs 158*a* and 158*b* to their respective connections 160*a* and 160*b*. However, in certain preferred examples, and as illustrated in FIG. 3D, the transition is sharp and defined by right angles in the outer contour of the ink pattern at corners 161*a* and 161*b*.

Referring to FIG. 3D, the "heating zone" of conductive ink circuit 147, which is the area where the most heat is generated when a potential difference is applied across conductive ink circuit 147. The heating zone has a length along the igniter length axis l that is represented as $l_{hz}$. The heating zone length $l_{hz}$ is defined as the distance from the proximal edge 159 of third or middle connector 156 to the distal edges 165*a* and 165*b* of first connector 160*a* and second connector 160*b*. In the example of FIGS. 3C and D, the distal edges 165*a* and 165*b* of connectors 160*a* and 160*b* are substantially straight, and preferably, are straight. The proximal edges 167*a* and 167*b* of first and second connectors 160*a* and 160*b* are preferably curved and are more preferably concave relative to their corresponding distal edges 165*a* and 165*b*. In FIG. 3D, the distal edge 157 of third connector 156 is preferably straight, and the proximal edge 159 of third connector 156 is preferably curved, and is more preferably convex relative to distal edge 157 and legs 162*a* and 162*b*. As a percentage of the overall conductive ink circuit 147 length, the heating zone length $l_{hz}$ is from 10 to 40 percent, preferably from 15 to 35 percent, and more preferably from 19 to 31 percent.

As mentioned earlier, FIGS. 3A, 3C, and 3D are referred to as a "TNL" embodiment, and in particular, a "TNL Flat Top" embodiment, with "flat top" referring to the straight distal-most edges 165*a* and 165*b* across the width of the igniter's conductive ink circuit 147. In the TNL embodiment, the igniter length along the length axis is generally from about 1.7 inches to about 2.3 inches, preferably from about 1.8 inches to about 2.2 inches, and more preferably from about 1.90 inches to about 2.0 inches. The overall length of conductive ink circuit 147 along the length axis l is preferably from about 1.6 inches to about 1.11 inches, preferably from about 1.7 inches to about 1.10 inches, and more preferably, from about 1.8 inches to about 1.9 inches. The resistive heating circuit 153 length along the length axis l is preferably from about 0.40 inches to about 0.44 inches, preferably from about 0.41 inches to about 0.43 inches, and more preferably from about 0.415 inches to about 0.425 inches.

The heating zone length $l_{hz}$ is preferably from about 0.15 inches to about 0.5 inches, preferably form about 0.17 inches to about 0.45 inches, and more preferably from about 0.19 inches to about 0.4 inches. The widths of legs 158*a*, 158*b*, 162*a*, and 162*b* along the width axis w are from about 0.008 inches to about 0.012 inches, preferably from about 0.009 inches to about 0.011 inches, and more preferably from about 0.0095 inches to about 0.00105 inches. The interleg spacing between legs 158*a* and 162*a*, as well as between legs 158*b* and 162*b* and legs 162*a* and 162*b* is from about 0.023 inches to about 0.027 inches, preferably from about 0.024 inches to about 0.026 inches, and more preferably from about 0.0245 inches to about 0.0255 inches.

Figure 3E:
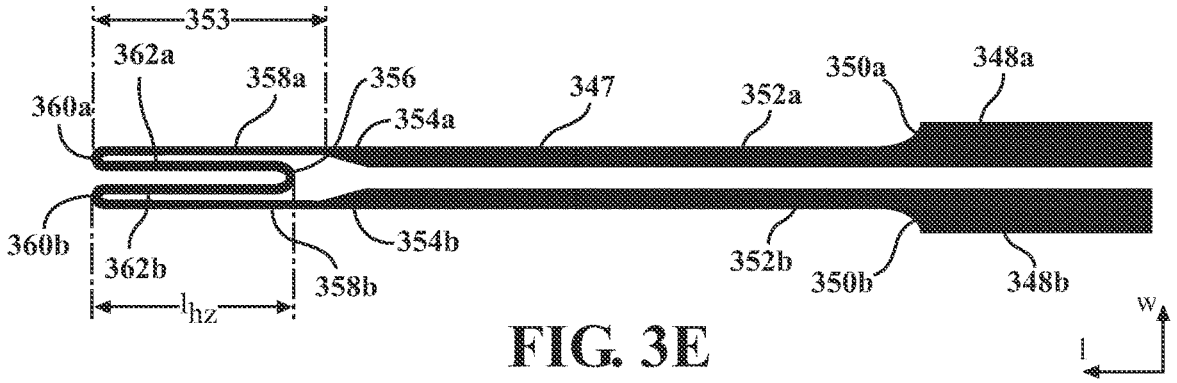
FIG. 3E is a top plan view of a conductive ink pattern for use in a TNL hot surface igniter in which the distal ends of the heating zone leg connectors are curved along the width direction of the igniter.
Figure 3F:
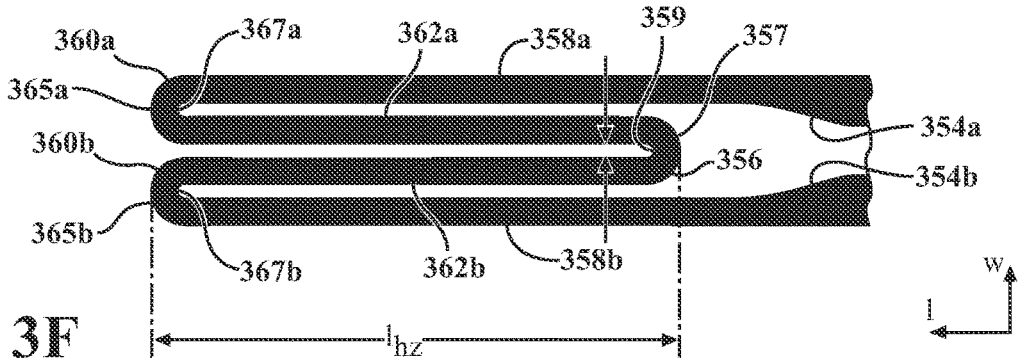
FIG. 3F is a top plan view of the distal end of the conductive ink pattern of FIG. 3E.

FIGS. 3E and 3F depict a "TNL Round Top" embodiment of a conductive ink circuit for the igniters 112 described herein. In one preferred example, the TNL round top conductive ink circuit is sandwiched between the same ceramic tiles described above for the TNL flat top igniter. The igniter 112 length along the length axis and the conductive circuit 147 length along the length axis are the same as for the TNL Flat Top embodiment of FIGS. 3C and 3D. "Round top" refers to the fact that the distal-most edges 365*a* and 365*b* of conductive ink circuit 347 are curved along the igniter width axis w. In particular, the distal-most edges 365*a* and 365*b* are convex relative to legs 358*a*, 358*b*, 362*a*, and 362*b*. Distal-most edges 365*a* and 365*b* preferably have a constant radius of curvature. The parts in FIGS. 3E and 3F correspond to those in FIGS. 3A and 3C except that the number in the hundreds position is a "3" instead of a "1." For example, leg 358*a* corresponds to leg 158*a* of FIG. 3C.

Proximal end connectors 348*a* and 348*b* are connectable to external leads used to power the conductive ink circuit 347. Concave transitions 350*a* and 350*b* connect respective connectors 348*a* and 348*b* to a respective one of leads 352*a* and 352*b*. Sloped transition regions 354*a* and 354*b* connect a respective lead 352*a* and 352*b* to a respective one of the resistive heating circuit legs 358*a* and 358*b* which are spaced apart from one another along the igniter width w axis. The length $l_{hz}$ of heating zone is the same as for the conductive ink pattern 147 of FIG. 3C. Similarly, the widths of legs 358*a*, 358*b*, 362*a*, 362*b*, and the interleg width axis spacings between adjacent pairs of the legs 358*a*, 358*b*, 362*a*, and 362*b* are from 0.016 to 0.020 inches, preferably from 0.017 to 0.019 inches, and more preferably from 0.0175 inches to 0.0185 inches.

Unlike FIGS. 3C and 3D, the distal-most edges 365*a* and 365*b* of connectors 360*a* and 360*b* are curved along the igniter width axis w. Preferably, the distal-most edges have a substantially constant radius of curvature defined by the spacing between the outermost (along the width axis) edges of legs 358*a* and 358*b*. In certain examples, the radius of curvature of distal-most edges 365*a* and 365*b* is from about 0.017 inches to about 0.021 inches, preferably from about 0.018 inches to about 0.020 inches, and more preferably from about 0.0185 inches to about 0.0195 inches. The proximal edges 367*a* and 367*b* are also curved along the width axis and preferably have a substantially constant radius of curvature defined by the inter-leg spacing. The radius of curvature of the proximal edges 367*a* and 367*b* is from about 0.007 inches to about 0.011 inches, preferably from about 0.008 inches to about 0.010 inches, and more preferably from about 0.0085 inches to about 0.0095 inches. Correspondingly, the radius of curvature of distal edge 359 of third connector 356 is the same as the radius of curvature of the proximal edges 367*a* and 367*b*, and the radius of curvature of proximal edge 357 of connector 356 is the same as the radius of curvature of distal edges 365*a* and 365*b* of connectors 360*a* and 360*b*.

Preferred igniters using the TNL round top conductive ink circuit of FIGS. 3E-3F achieve the same thermal characteristics as those of FIGS. 3A, and 3C-3D. Thus, when subjected to a potential difference of 120V AC, the outer surface reaches a surface temperature of at least 1400° F., preferably no less than 1800° F., more preferably no less than 2100° F., and even more preferably no less than 2130° F. in no more than four seconds after the potential difference is applied. Each of these temperatures is preferably reached in no more than three seconds, more preferably reached in no more than two seconds, and still more preferably, reached in no more than one second after the potential difference is first applied.

In the same or additional examples, when subjected to a potential difference of 120V AC, igniters using the TNL round top conductive ink circuit 347 of FIGS. 3E-3F reach an outer surface temperature that does not exceed 2600° F., preferably does not exceed 2550° F., more preferably does not exceed 2500° F., and still more preferably does not exceed 2450° F. at any time after the 120V AC potential difference is applied, including after a steady-state temperature is reached.

In the same or other examples of hot surface igniters in accordance with the present disclosure, when subjected to a potential difference of 102V AC, the hot surface igniters using the TNL round top conductive ink circuit of FIGS. 3E-F reach a surface temperature of at least 1400° F., preferably at least 1800° F., and still more preferably at least 2100° F. no less than 2050° F., preferably no less than 2080° F., and more preferably no less than 2130° F. in no more than five seconds after the 102V AC potential difference is applied. Each of these temperatures is preferably reached in no more than four seconds, and more preferably reached in no more than three seconds.

Figure 3G:
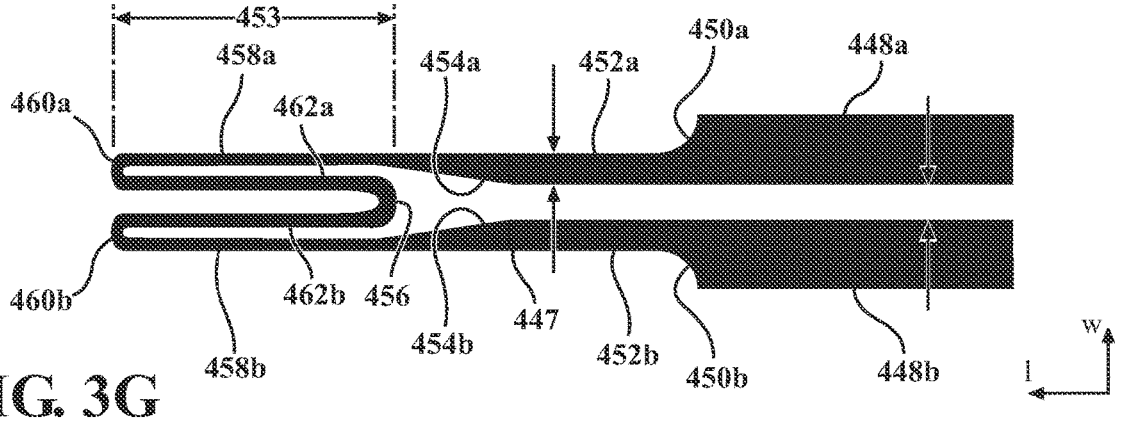
FIG. 3G is a top plan view of a conductive ink pattern for use in a "thin nitride, short" (TNS) hot surface igniter in which the distal ends of the heating zone leg connectors are curved along the width axis of the igniter.
Figure 3H:
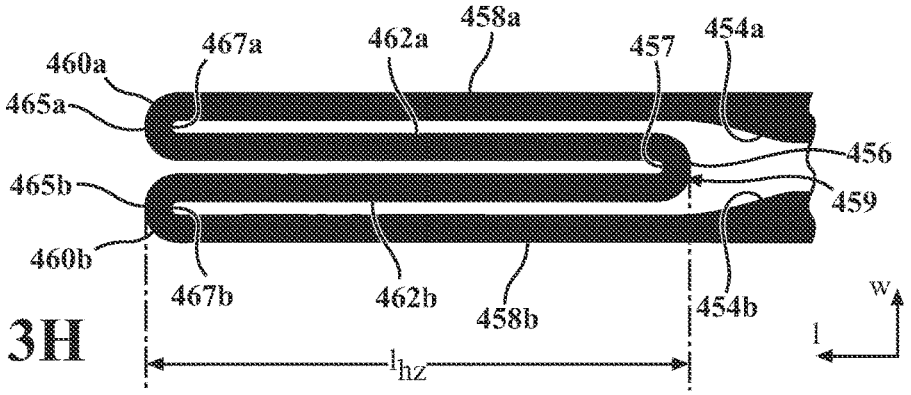
FIG. 3H is a top plan view of the distal end of the conductive ink pattern of FIG. 3G.

In accordance with certain examples, a "thin nitride, short" or "TNS" igniter is also provided. The ceramic tile and conductive ink compositions are the same as those described for the TNL igniters. However, the igniter length along the length axis is from about 1.0 to about 1.5 inches, preferably from about 1.1 inches to about 1.4 inches, and more preferably from about 1.15 to about 1.35 inches. The ignite width along the width axis is from 0.16 to 0.21 inches, preferably from 0.17 to 0.20 inches, and more preferably from 0.18 to 0.19 inches. An exemplary conductive ink circuit 447 is shown in FIG. 3G for a TNS igniter. The components of the conductive ink circuit 447 correspond to those of conductive ink circuits 147 and 347, described previously, except that the digit in the hundreds position is "4". Thus, connectors 448*a* and 448*b* are connectable to external leads and are connected to conductor leads 452*a* and 452*b* by respective concave transitions 450*a* and 450*b*. Each lead 452*a* and 452*b* is connected to a respective sloped transition 454*a* and 454*b*, which are in turn connected to a respective one of resistive heating zone legs 458*a* and 458*b*. Resistive heating zone 453 comprises four legs 458*a*, 460*a*, 458*b*, and 460*b* having lengths along the length axis and being spaced apart from one another along the igniter width axis. Connector 460*a* connects leg 458*a* to leg 462*a*, and connector 460*b* connects leg 458*b* to leg 462*b*. The conductive ink circuit of FIGS. 3G and 3H is a "round top" circuit like that of FIGS. 3E and 3F. Thus, connectors 460*a* and 460*b* have distal edges 465*a* and 465*b* that are curved along the igniter width axis, and respective proximal edges 467*a* and 467*b* that are curved along the igniter width axis. Similarly, connector 456 that connects legs 462*a* and 462*b* has a curved distal edge 457 and a curved proximal edge 459. The dimensions of the resistive heating circuit 453, the heating zone length $l_{hz}$, the widths of legs 458*a*, 458*b*, 460*a*, 460*b*, the radii of curvature of distal connector edges 465*a*, 465*b*, 457, and radii of curvature of proximal connector edges 467*a*, 467*b*, and 459 are preferably the same as for the corresponding parts and dimensions of conductive ink circuit 347 of FIGS. 3E and 3F. Thus, the TNL round top and TNS round top embodiments of FIGS. 3E-F and 3G-H will have substantially identical heating characteristics. However, owing to its shorter length, the TNS round top igniter embodiment will fit it into a smaller envelope than the TNL round top embodiment.

The conductive ink compositions and thicknesses along the igniter thickness axis t of the conductive ink circuits 347 and 447 are preferably the same as for conductive ink circuit 147. The conductive ink circuits 347 and 447 are preferably sandwiched between ceramic tiles of the same composition as those of FIGS. 3A, and 3C-3D, and thus, the resulting igniters preferably have the same flexural strength.

Figure 4:
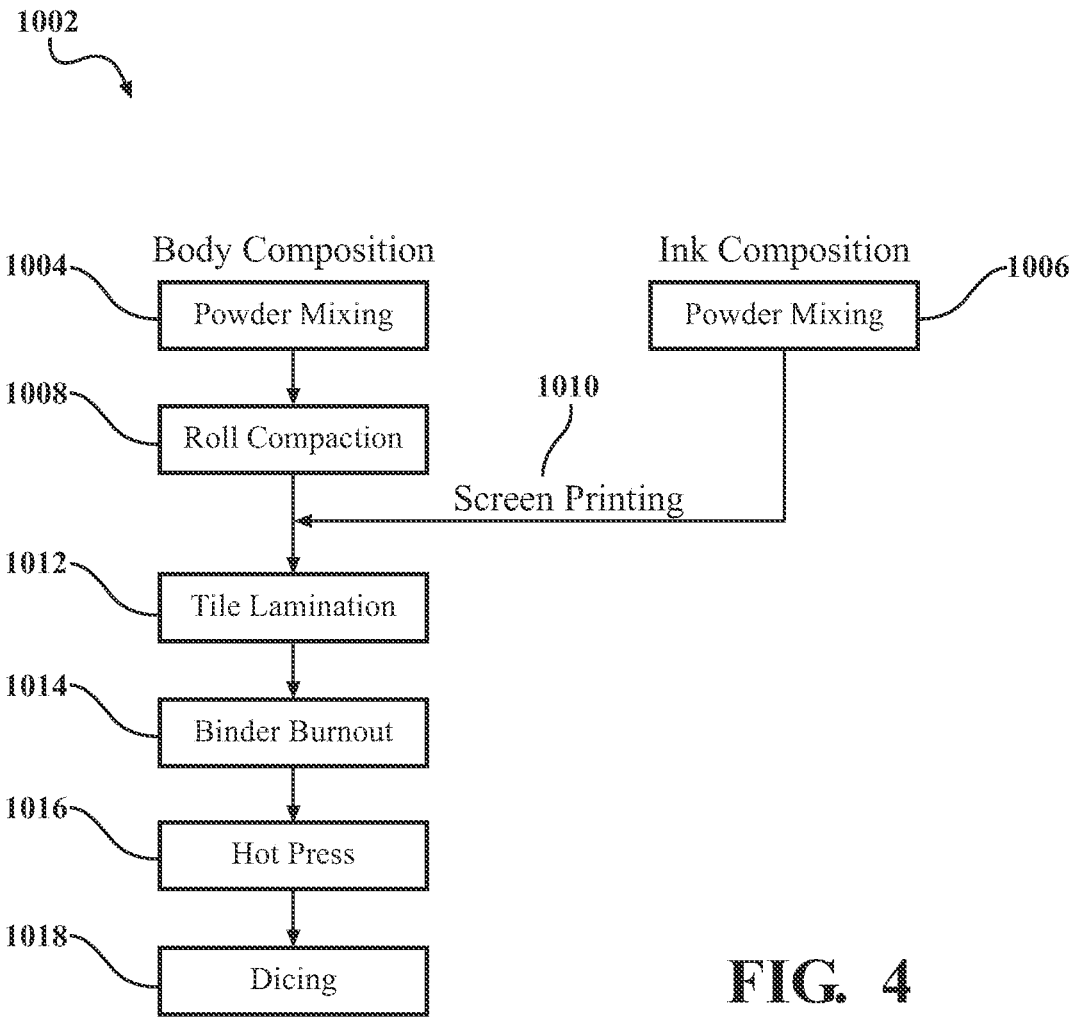
FIG. 4 is process flow diagram illustrating a method of making a hot surface igniter in accordance with the present disclosure.

Referring to FIG. 4, an exemplary method 1002 of making the hot surface igniters 112 will now be described. In a first powder processing step 1004, ceramic powders comprising the compounds used to form the ceramic tiles 140, 142 and distilled or de-ionized water are weighed out in accordance with their desired weight percentages and added to ajar mill with alumina grinding media. The jar mill is sealed and, and the powders are rolled to create a homogenous mixture. The mixture is then screened through a fine mesh screen to remove any large, hard agglomerate. Binder emulsions are further added to form the final slurry or slip. The slip is then formed into a green igniter tape using tape casting. In tape casting, the slip is passed between a doctor blade and a Mylar® sheet to form a continuous thickened tape. Roll compaction may be used to further increase the green density of the tape.

Alternatively, high shear compaction may be used in step 1008, which eliminates the need for forming a slurry. High shear compaction is a proprietary process of Ragan Technologies, Inc. of Winchendon, Mass. In high shear compaction ceramic powders and binder are mixed and dispersed using high shear forces. The material is maintained at a very high viscosity and subjected to very high shear forces. The particles cannot settle, preventing non-uniform particle size distribution along the z-axis (thickness axis). The resulting tapes are isotropic, and the process provides a fine degree of thickness control. Tiles are then cut into small squares and laser marked to facilitate alignment for screen printing and dicing.

In step 1006 the ink components are mixed with a binder, and in step 1010 the ink is screen printed onto the tiles and allowed to dry. The screen printed tiles are then laminated with a blank cover tile (i.e., a ceramic tile 140 or 142 in FIG. 3A without the screen printed circuit) in preparation for binder burnout. (Step 1012). The tiles 140 and 142 are referred to as "green" (unsintered) tiles at this point.

In step 1014 the green tiles are burned out in air at a prescribed temperature based on the organic powder used in the powder preparation process. Approximately 60-85% of the binder is removed. The remaining binder is necessary to provide handling strength.

Hot pressing is then performed in step 1016. During this step, the tiles are loaded into a hot press die, which is loaded into a controlled atmosphere furnace. The air in the furnace is evacuated and replaced with nitrogen to provide an inert environment free of oxygen. The furnace is typically vacuumed down and back filled with nitrogen three times. The furnace is left under vacuum, and power is applied to the furnace. A continuous vacuum is pulled on the furnace until the temperature reaches 1100° C. to aid in removal of the remaining organics. At this time the furnace is back filled with nitrogen and pressure is applied to the parts via a hydraulic ram. The pressure is slowly increased over time until the desired pressure is reached. Pressure is held until the completion of the sintering soak carried out at 1780° C. for 80 minutes. The temperature is controlled until a prescribed temperature at which point the pressure on the ram is released and the power to the furnace is removed. When the parts are cooled they are removed from the furnace and cleaned up in preparation for a dicing operation. Step 1018.

During dicing, the individual elements are diced out of tile using a diamond dicing saw. Laser marks from lamination process are used to define were the dicing saw cuts should be made.

Electrical terminals are brazed onto the elements using a Ti—Cu—Ag braze paste to form the external leads (not shown). The brazed igniter elements are assembled into ceramic insulator 118 formed from a suitable ceramic such as alumina, steatite, or cordierite. The elements are connected to the insulator using a ceramic potting cement.

In accordance with another aspect of the present disclosure, the burner assemblies herein may be used with an ignition control scheme that avoids prolonged energization of the igniter 112. In accordance with this aspect, a burner 110 of the type described previously is provided. The igniter 112 is selectively connected to a source of power to heat the igniter 112 when desired. A user control (e.g., a cooktop knob) is provided, and when the user is performing an ignition actuation operation on the user control, the hot surface igniter 112 is energized, and when the user is not performing the ignition actuation operation control, the hot surface igniter 112 is de-energized. In certain examples, the user control is operatively connected to a switch that selectively places the hot surface igniter 112 in electrical communication with the power source during the ignition actuation operation. The ignition actuation operation may involve turning the cooktop knob to a "light" setting or pushing the knob in and holding it. In certain examples, the user control is operable both to ignite the igniter 112 and to supply cooking gas to the burner 110.

In accordance with another aspect of the present disclosure, the burner assemblies described herein may be used with a simmer control scheme. In such examples, the cooking gas supplied to the burner 110 is pulse-width-modulated. For example, cooking gas may be supplied to the burner for a first time period and then ceased for another time period in an alternating sequence. In such examples, the igniter 112 is preferably energized during the first time period only.

Another benefit of a hot surface igniter is that the resistivity of the conductive ink circuits is temperature dependent. This temperature dependence may be used to determine whether a flame is present. In the absence of a flame, the temperature of the igniter will drop to an extent indicated by the resistance of the conductive ink circuit. For example, a separate conductive ink circuit comprising a resistive heating portion may be provided on igniter 112 and used to determine if a flame is present by measuring the resistance and/or a change in the resistance of the circuit. Alternatively, a separate igniter body may be provided in the same insulator or an adjacent one and used to sense the presence of a flame. In certain examples, a control system may be provided which shuts off the flow of cooking gas when no flame is detected.

In accordance with other examples, igniter 112 operates in a full power mode during initial ignition and in a reduced power mode during cooking (second mode). The average of 120 V rms AC power (per cycle) received by the hot surface igniter 112 in the reduced power or "cooking" (second) mode is preferably no more than 90 percent of the power received by the igniter 112 during the initial ignition mode, more preferably, no more than 80 percent of the power received by the igniter 112 during the initial ignition mode, and still more preferably, no more than 70 percent of the power received by the ignite 112 during the initial ignition mode.

In certain examples, during an initial ignition operation the igniter 112 receives a full-wave alternating current from an alternating current source during a first (ignition) mode of operation and a half-wave, rectified alternating current from the alternating current source during a second (cooking) mode of operation. Preferably, the igniter 112 has a surface temperature that remains above the auto-ignition temperature of the cooking gas during the second mode of operation.

Referring to FIGS. 5A-5C, a variety of igniter circuits are depicted. The igniter circuits comprise an ignition circuit and a cooking circuit (or "re-ignition circuit" because it keeps the igniter supplied with sufficient power to ignite cooking gas in the event of a flame out). The igniter circuits 200, 210, and 230 all comprise a source of alternating current 201, which in the United States would preferably 120 V (rms) alternating current on a 60 Hz cycle. The power source would be tailored to the region of the world. For example, in Europe the source of alternating current would be 240 V (rms) at 50 Hz.

Igniter circuit 200 of FIG. 5A comprises an alternating current source 201, hot surface igniter 112, diode 202, switch 204, and current sensor 207. Igniter 112 is in series with alternating current source 201. Switch poles 206 and 208 are also part of igniter circuit 200. When switch 204 is open (not contacting poles 206 or 208), igniter 112 is de-energized, such as when the corresponding burner 110 is off.

During an initial ignition (as opposed to re-ignition) operation, switch 204 contacts pole 206, leaving pole 208 open. Thus, the alternating current flows through an ignition circuit from terminal 203 to switch pole 206, to node 209, and through hot surface igniter 112 to terminal 205 during one-half cycle and then in the opposite direction during the second half cycle. The resulting voltage signal as seen by hot surface igniter 112 is the full wave signal shown in FIG. 6A.

Following initial ignition, during a cooking operation, switch 204 contacts pole 208, leaving pole 206 open. Thus, no current flows through the circuit branch from pole 206 to node 209. Current flows through a cooking circuit (or "re-ignition circuit" because the igniter 112 is ready to reignite gas in case of a flame out) from the power source 201, through pole 208, through diode 202, and through hot surface igniter 112 during one half cycle. Because diodes only conduct in one direction, during the other half-cycle of the alternating current diode 202 does not conduct, and no current flows through the hot surface igniter 112. The resulting voltage signal as seen by the hot surface igniter is a half-wave rectified signal of the type shown in FIG. 6B. As a result, the igniter is supplied with half of the average power during a full-voltage cycle as when in the ignition mode with switch 204 connected to pole 206. In preferred examples, in the cooking mode with switch 204 connected to pole 206, the hot surface igniter 112 reaches a steady-state surface temperature (at steady state) that is above the auto-ignition temperature of the cooking gas. In the same or other examples, in the cooking mode at 120 V AC (rms), the surface of the hot surface igniter 112 reaches a steady-state surface temperature of at least 1700° F., preferably at least 1800° F., and more preferably at least 1900° F. In preferred examples, when gas valve 102 is closed, switch 204 returns to the open position shown in FIG. 5A to de-energize the igniter 112.

A current sensor 207 (not shown) may be provided between igniter 112 and node 209. Current sensor 207 detects whether current is flowing to hot surface igniter 112 and can be used to detect an igniter failure when switch 204 is connected to poles 206 or 208. In the event of a failure, current sensor 207 will generate a signal indicative of failure. The signal may be used by controller 104 to close the corresponding gas valve 102, thereby preventing uncombusted gas from filling the room in which the cooktop is present.

Referring to FIG. 5B, another example of an igniter circuit 210 is shown. Circuit 210 comprises a power source 201 with positive terminal 203 and negative terminal 205. It also comprises igniter 112, triac 216, triac gate 213, and triac gate resistor 214. Igniter 112 is in series with alternating current source 201.

Figure 6A:
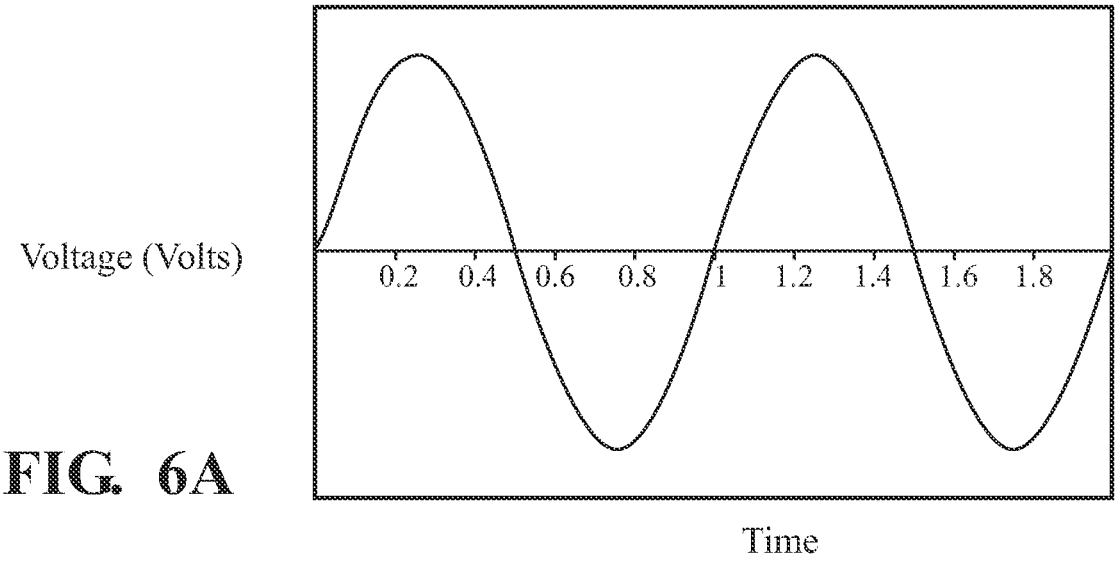
FIG. 6A is a graph depicting the voltage supplied to a hot surface igniter of the present disclosure during an ignition operation using the ignition circuit of FIG. 5A.
Figure 6B:
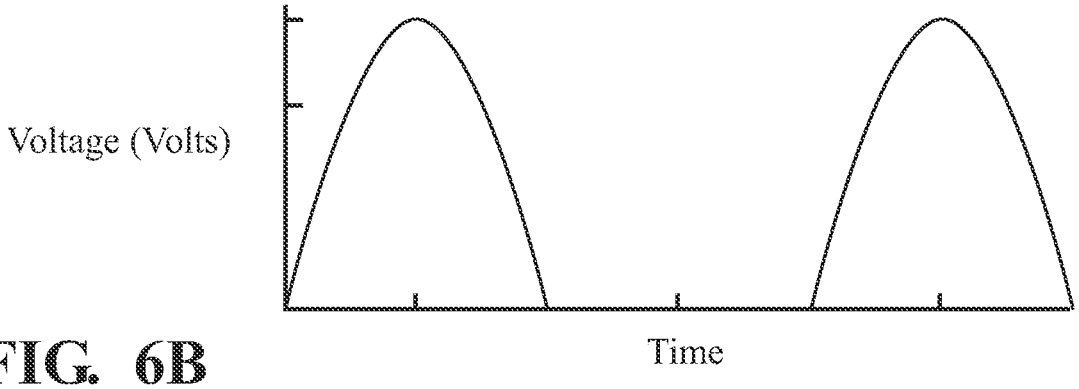
FIG. 6B is a graph depicting the voltage supplied to a hot surface igniter of the present disclosure during a cooking operation using the cooking circuit of 5A.
Figure 6C:
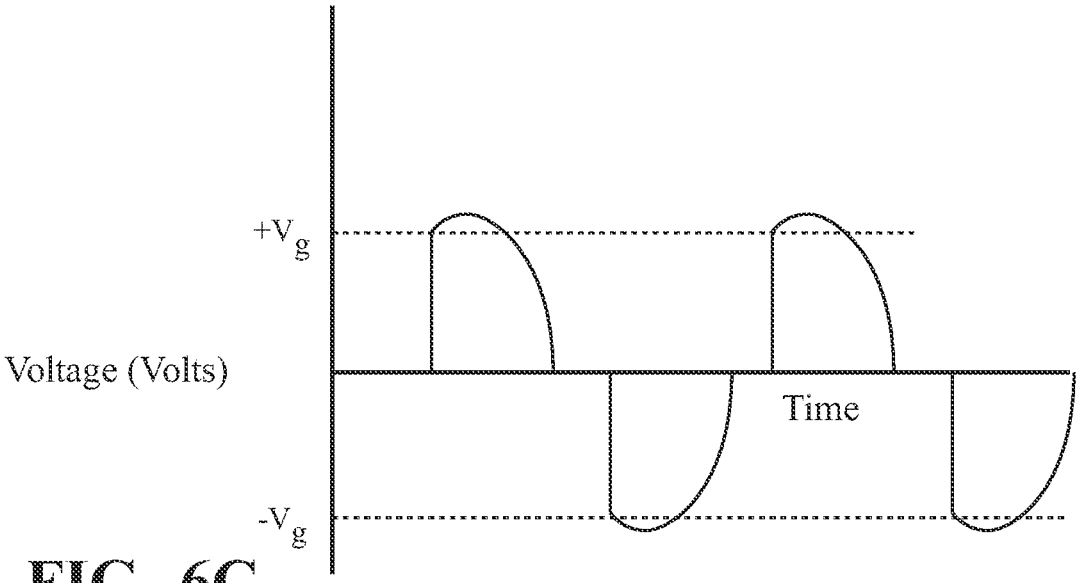
FIG. 6C is a graph depicting the voltage supplied to a hot surface igniter of the present disclosure during a cooking operation using the cooking circuit of FIG. 5B.

In an initial ignition mode, switch 211 contacts pole 220. Thus, full wave cycles of alternating current flow through an ignition circuit from power source 201 to switch pole 220, node 215, and igniter 112, bypassing the triac 216 and gate resistor 214. However, when switch 211 contacts pole 218, gate resistor 214 will cause triac gate 213 to see a voltage lower than the voltage of source 201. Until the voltage at triac gate 213 exceeds the triac's threshold gate voltage $V_g$, triac 216 will not conduct. Once the voltage at triac gate 213 exceeds the triac's threshold gate voltage, it will conduct, and current will flow through a cooking circuit from power source 201 to switch pole 218, through triac 216, node 215, and igniter 112. Unlike a diode, triac 216 conducts bidirectionally as long as the gate is triggered. The voltage signal at igniter 112 is as shown in FIG. 6C. Until the source voltage is high enough that the triac gate exceeds the triac's threshold gate voltage Vg, no current will flow through the triac 216, and the igniter 112 will effectively see a zero or very low voltage. Once the source voltage causes the triac gate to see a voltage above Vg, the triac 216 will conduct. The resulting average power received by the igniter 112 during a cooking mode is less than that during the ignition mode. The resistance value of gate resistor 214 may be selected to provide the desired average power per cycle to igniter 112, and hence, to dictate the steady-state surface temperature of igniter 112 during the cooking mode. In preferred examples, when cooking gas valve 102 is closed, switch 211 returns to the open position shown in FIG. 5B.

Referring to FIG. 5C, a third example of an igniter circuit 230 is shown. In accordance with the example, alternating current source 201 is provided and includes positive terminal 203 and negative terminal 205. Igniter 112 is in series with alternating current source 201. Igniter circuit 230 comprises power source 201, switch 242 with poles 231 and 240, triac 232, diac 234, diac resistor 238, and capacitor 236. During the initial ignition mode, switch 242 is in contact with pole 240, and alternating current flows through an ignition circuit from power source 201, through switch pole 240, nodes 237 and 233, and through igniter 112. Thus, the igniter 112 sees the full-wave source voltage as with the circuits of FIGS. 5A-5B. In preferred examples, when cooking gas valve 102 is closed, switch 242 returns to the open position shown in FIG. 5C.

During the cooking mode, switch 242 is in contact with pole 244. As the source voltage increases from zero, capacitor 236 charges until it reaches saturation. As the source voltage falls below the saturation voltage of capacitor 236, the voltage at diac 234 eventually reaches the diac breakover voltage (due to the stored energy of capacitor 236), allowing current to flow into gate 235 to trigger the gate. Triac 232 then conducts, causing current to flow through a cooking circuit from power source 201 to switch pole 244, through triac 232, to node 237, node 233, and through igniter 112. Many triacs 232 do not fire symmetrically, and diac 234 makes the firing point of the triac 232 more even in both directions. The resistance value of resistor 238 affects when the diac 234 reaches its break over voltage in a given alternating current cycle. Thus, the resistance value of resistor 238 may be selected to achieve a desired steady-state surface temperature for hot surface igniter 112 during a cooking mode.

In certain examples, the igniter circuits of FIGS. 5A-5C are operatively connected to controller 104 (FIG. 1), which receives a flame sensing signal indicative of whether the burner 110 is lit. In accordance with such examples, if the burner 110 is lit, the controller 104 adjusts the position of the corresponding switch 204, 211, 242 to place the circuit in a cooking mode wherein the corresponding igniter 112 receives less than full AC power so that the hot surface igniter 112 remains energized with a steady-state surface temperature exceeding the autoignition temperature of the cooking as, as described previously. In addition, a current sensor may be used with any of the FIG. 5A-5C circuits (in series with igniter 112) to determine whether current is flowing to the hot surface igniter 112. If no current is flowing, the current sensor would generate a signal received by controller 104, which would then shut the corresponding gas valve 102 to prevent uncombusted gas from filling the kitchen. Table 4 illustrates exemplary modes of operation for burner 110. User controls and controller 104 may be configured to provide the desired modes of operation:

TABLE 4

| | Igniter Mode | | |
|---|---|---|---|
| Switch Position | OFF | IGNITION | COOKING |
| 0 | Gas Flow OFF<br>AC OFF | | |
| 1 | | Gas Flow on<br>Ignition Flow<br>Ignition Circuit | |
| 2 | | | Any Gas Flow<br>Cooking Circuit |

The "switch position" column refers to the switches 204, 211, and 242 in FIGS. 5A-5C.

In accordance with Table 4, in the first switch position (position 0), gas valve 102 is closed, and no alternating current (AC) is supplied to igniter 112. In the igniter circuits of FIGS. 5A-5C, switches 204, 211, and 242 would be open.

When switches 204, 211, and 242 are in their ignition position (position 1), the igniter circuit's ignition circuit is activated, and preferably, the gas valve 102 is open to provide the desired gas flow rate to the igniter 112. In certain examples, the gas valve 102 is not manipulable to change the gas rate from the ignition gas flow rate while the igniter circuit's ignition circuit is activated.

When switches 204, 211, and 242 are in their cooking position (position 2), the igniter circuit's cooking circuit is activated, and the gas valve 102 is manipulable through the full range of gas flow rates. When the cooking circuit is activated, re-ignition may occur if the cooking gas flow rate is sufficient to provide an air/gas mixture at the igniter 112 that is between the LEL/LFL and UEL/UFL of the igniter 112. Thus, the burner crown 113 is preferably designed to ensure that even at the lowest cooking gas flow rate to the burner, a sufficient cooking gas flow rate is provided to the igniter 112 to cause ignition.

Cooktop system 100 preferably includes a plurality of user controls for adjusting the flow of cooking gas from valves 102 to their respective burners 110 and for energizing the igniters 112. The user controls are operable to adjust the position of an igniter circuit switch (e.g., switches 204, 211, 242) to selectively energize an ignition circuit or a cooking circuit (or de-energize the igniter 112), as well as to open and close a corresponding gas valve 102.

In certain examples, the user controls are operable to place each burner 110 in an ignition mode, a cooking mode, and an off mode. In the ignition mode, igniter 112 is operatively connected to an ignition circuit (for example, as described with respect to FIGS. 5A-5C) and preferably receives full power from the power source 201 in whichever ignition circuit is in use. In cooking mode, the igniter 112 is operatively connected to a cooking circuit (for example, as described with respect to FIGS. 5A-5C) and receives reduced average power from the power source 201, albeit sufficient power to maintain a steady-state igniter surface temperature above the cooking gas autoignition temperature. Preferably, the burner 110 is designed such that when the flow rate of cooking gas to the burner 110 is at a minimum (such as when the burner is set for "simmer"), and the igniter 112 is at its steady-state temperature, the flow rate of gas and air to the igniter 112 is sufficient to cause ignition in no more than six seconds, preferably no more than five seconds, and still more preferably, no more than four seconds from the resumption of gas flow to the burner 110. In the same or other examples, at steady state the igniter surface temperature is preferably at least 1700° F., more preferably, at least 1800° F., and even more preferably, at least 1900° F. In the same or other examples, during ignition of methane or butane 1400, the total gas flow rate to the burner 110 (via supply line 124) is no more than 1.8 L/min, preferably no more than 1.0 L/min, and still more preferably no more than 0.2 L/min, and during the ignition of n-butane or propane HD-5, the total gas flow rate to the burner 110 (via supply line 124 is no more than 2.7 L/min, preferably no more than 1.5 L/min, and more preferably, no more than 0.32 L/min. At the same time, the ratio of the volumetric gas flow rate to the igniter 112 through igniter orifice 130 relative to the volumetric gas flow rate to the flutes 117 in simmer mode (or another low burner gas flow rate mode) is at least 0.0055, preferably at least 0.05, and more preferably at least 0.45.

In the same or other examples, the user controls are operable to place the power supply in electrical communication with the hot surface igniter 112 and to place the supply of cooking gas 106 in selective fluid communication with the hot surface igniter 112. In the same or other examples, the user controls are manipulable in a first dimension to supply power to the hot surface igniter 112 or to select one or the other of the ignition circuit and the cooking circuit, as well as in a second dimension to supply and adjust the flow rate of cooking gas to the hot surface igniter by opening valve 102. In preferred examples, when the user control is in a position such that the igniter 112 is de-energized, the user control is not manipulable to open gas valve 102, which prevents the user from filling the room with uncombusted cooking gas.

In one implementation, the user control is a knob that is manipulable in two dimensions such as by rotation around an axis of rotation and displacement along the axis of rotation. In one example, no flame sensor is provided, and the knob is not rotatable until it is pushed in. When the knob is pushed in, the igniter circuit's ignition circuit is energized, and the knob becomes rotatable (e.g., by using a detent that is pushed in) to an ignition gas position. The knob is then rotated to an ignition position to open the gas valve, while still keeping the knob pushed in. A detent or similar mechanism keeps the knob from further rotating while it is pushed in. Once the knob is released, it can be turned to vary the gas flow. The release of the knob causes the igniter circuit to switch from the ignition circuit to the cooking circuit. When the knob is rotated to the "off" position, the igniter circuit is switched to the "off" mode, and the gas valve 102 is closed. In certain preferred examples, the gas flow rate during an ignition operation is less than the maximum gas flow rate and is a "medium" or "low" flame setting gas rate. Exemplary total gas flow rates to each burner 110 supply line 124 during ignition are no more than 2.7 L/min, preferably no more than 1.0 L/min, and more preferably no more than 0.2 L/min.

If a flame sensor is provided, in one example, the user does not need to keep pushing the user control during an ignition operation. Instead, pushing it in once will activate the igniter circuit's ignition circuit, and the ignition circuit will remain active until the flame sensor detects a flame or the user control is returned to the "off" position. While the ignition circuit is active, if the flame sensor detects a flame, the controller 104 may activate the igniter circuit's cooking circuit to place the burner 110 in a cooking mode. The burner 110 will remain in the cooking mode until it is turned to the "Off" position. The use of a reduced power re-ignition/cooking mode provides the safety of a re-ignition system in the case of a flame out while significantly increasing the igniter 112 cycle life as compared to keeping the igniter 112 energized at full power after ignition is complete.

Example 1

Figure 7A:
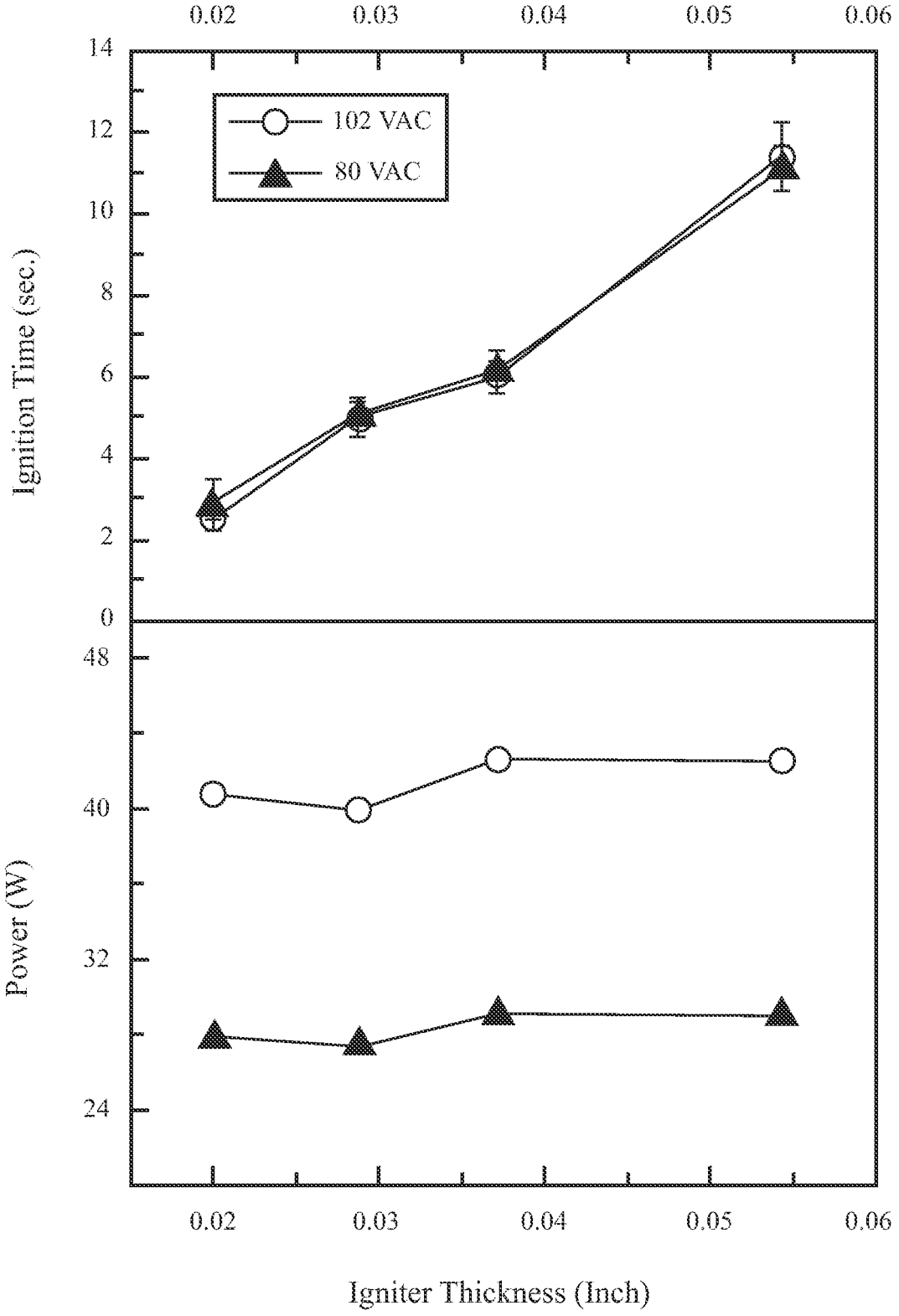
FIG. 7A is a plot of power and ignition time versus hot surface igniter thickness for four (4) hot surface igniters having the same conductive ink composition, pattern, and dimensions at 80 and 102 Volts AC.

Four (4) hot surface igniters are formed by hot pressing and sintering green body silicon nitride igniters in accordance with the method of FIG. 4. The post-sintered igniters have respective thicknesses of 0.02 inches, 0.025 inches, 0.037 inches, and 0.054 inches. Each of the igniters has the same room temperature resistance (50±2Ω), the same ceramic body length, width, and composition, and the same ink composition. As shown in FIG. 7A, the thinner igniters have a somewhat smaller power draw, which is desirable from an energy consumption standpoint. However, the time to temperature for both voltages is a strong function of igniter body thickness. With the 0.02 inch igniter reaching the target temperatures in about 2.5 seconds at each voltage, and the 0.054 inch igniter reaching the target temperatures in about 11 seconds at each voltage. The data demonstrate the desirability, from a thermal standpoint, of making hot surface igniters thinner to achieve faster times to temperature.

Example 2

Figure 7B:
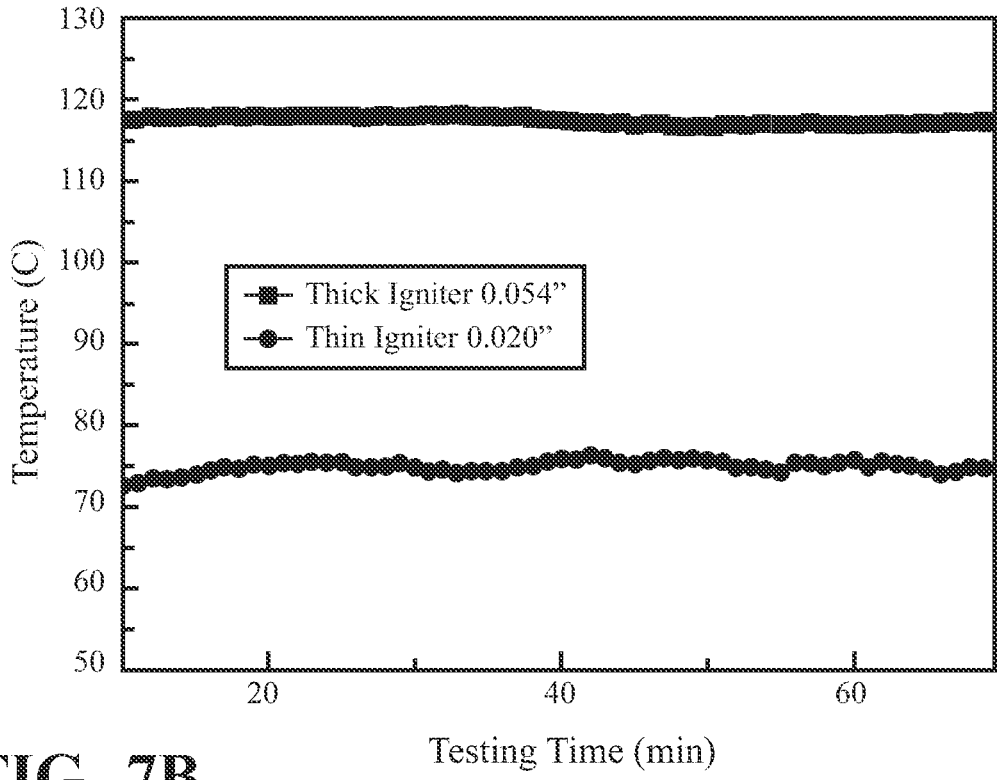
FIG. 7B is a plot of the insulator temperature of two hot surface igniters of different thicknesses and having the same igniter ceramic body surface temperature.

This example concerns the thermal management of hot surface igniters having different thicknesses along the thickness axis. Certain components of the hot surface igniter are unheated. For example, the insulators 118 of FIGS. 2E and 2F are unheated. During long term operation of the hot surface igniter 112, the insulators 118, their igniter electrical terminal brazing, and their filler materials may become very hot, which may lead to igniter failure. As the igniter becomes thinner along the thickness axis at a constant length and width along the length and width axes, the insulator's 118 insulating effect is greater, resulting in a lower insulator 118 surface temperature. Two hot surface igniters formed from silicon nitride ceramic bodies with an embedded conductive ink circuit of the type described previously are prepared. The ink compositions are identical, and the conductive ink patterns are the same and have the same dimensions. However, the first igniter has a thickness of 0.054 inches along the thickness axis, and the second igniter has a thickness of 0.020 inches along the thickness axis. The igniters are disposed in identical insulators with identical amounts and types of filler. The igniters are subjected to a voltage of 120 V AC and the temperature of the insulator 118 outer surface is measured for about 70 minutes. The results are shown in FIG. 7B. The 0.054 inch igniter has an outer surface temperature of about 118° C. over the 70 minute period. However, the 0.020 inch igniter has an outer surface temperature of about 72° C. to 75° C. over the entire period. Thus, the thinner igniter is less likely to degrade the igniter's electrical terminal brazing, the insulator and/or its filler which beneficially prolongs the igniter's life.

Example 3

Four types of igniters are prepared each comprising two ceramic tiles having a conductive ink composition therebetween. The ceramic tiles comprise 82 percent silicon nitride, thirteen (13) percent ytterbium oxide, and five (5) percent molybdenum disilicide (each percentage by weight of the igniter) body. Two of the igniters (TNS round top) have an overall (sintered) igniter thickness of 0.025 inches, a conductive ink thickness of 0.0005 inches, an igniter length of 1.19 inches, and a conductive circuit length of 1.106 inches. The other two igniters (TNL round top) have an overall igniter thickness of 0.055 inches, a conductive ink thickness of 0.0005 inches, a conductive circuit length of 1.816 inches, and an igniter length of 1.9 inches.

Two igniters of each type (TNL and TNS) are provided with one of two conductive ink circuits: an ytterbium oxide-containing circuit and an ytterbium oxide-free circuit. The ytterbium oxide-containing circuit comprises 75 percent tungsten carbide, twenty (20) percent silicon nitride, three (3) percent ytterbium oxide, and two (2) percent silicon carbide (each percentage by weight of the conductive ink). The ytterbium free conductive ink comprises 75 weight percent tungsten carbide, 23 weight percent silicon nitride, and two (2) weight percent silicon carbide. The ink pattern for the TNL-round top igniters is as shown in FIGS. 3E and 3F. The ink pattern for the TNS igniter is as shown in FIGS. 3G and 3H. The two TNL igniters are identical in every respect except that one has the ytterbium-free conductive ink composition and the other has the ytterbium-oxide containing conductive ink composition. The two TNS igniters are identical in every way except for the same compositional difference.

Figure 8:
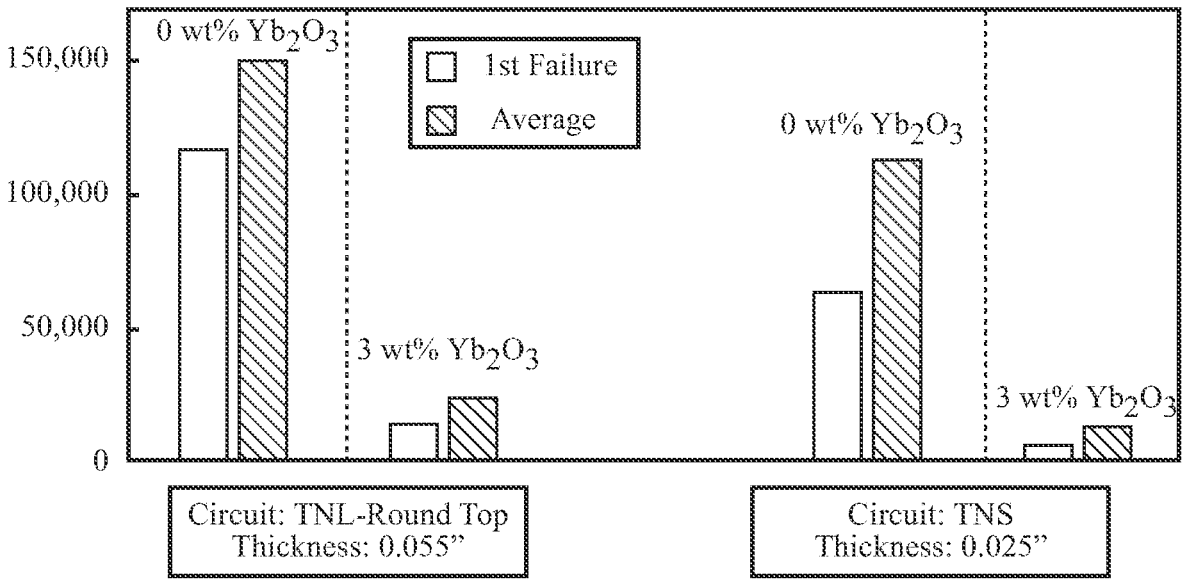
FIG. 8 is a plot of on/off cycles versus igniter type depicting the shortest and average cycle life of eighteen (18) samples of each of four hot surface igniters showing the effect of the conductive ink ytterbium oxide content on igniter life.

18 parts of each of the four igniter types are prepared and are subjected to life cycle testing in which a 132V voltage is applied to each part for consecutive 30 second cycles (i.e. the voltage is ON for 30 seconds and OFF for 30 seconds in each cycle). The number of cycles at which the first failure (i.e., the igniter fails to ignite or fails to reach the desired temperature, which may be due to a breakdown in the conductive ink circuit and/or the igniter body material) for each igniter type is determined as is the average number of cycles at which failure occurs over the sample size of 18 parts. The results are shown in FIG. 8. FIG. 8 demonstrates the unexpected result that the igniters which have an ytterbium-oxide free conductive ink circuit have an increased average cycle life that is at least six fold that of the same igniter body with the ytterbium-oxide containing circuit. The life time of the first part to fail shows similar results across each of the four igniter types. Without wishing to be bound by any theory, it is believed that the exclusion of ytterbium-oxide and other rare earth oxide sintering aids from the conductive ink is responsible for the significant increase in igniter life time. It is further believed that the exclusion of rare earth oxide sintering aids eliminates a glassy phase from the ink which, if present, might start re-softening or undergo other glass transitions from the eutectic reaction when the igniter is in use. The plastic flow of the glassy phase could lead to a short circuit that eventually causes the igniter to fail.

Example 4

This example demonstrates the effects of the ink pattern at the transitions between axial legs (e.g., connectors 160*a*, 160*b*, 360*a*, 360*b*, 460*a*, 460*b*) in the heating zone. Two types of TNL igniters having the conductive ink pattern of FIGS. 3C-3D on the one hand and FIGS. 3E-3F on the other hand are prepared. The ink compositions used in each igniter are the ytterbium-oxide free compositions described in Example 3. The ceramic tiles have the composition described in Example 3, and the total thickness of each type of igniter is 0.055 inches. The conductive ink patterns are identical in each igniter, except that the first igniter uses the TNL flat top pattern of FIGS. 3C-3D, and the second igniter uses the TNL round top pattern of FIGS. 3E-3F. The dimensions of the various sections of the ink patterns are as described previously for the patterns of FIGS. 3C-3D and FIGS. 3E-3F. Legs 158*a*, 158*b*, 162*a*, 162*b* and 358*a*, 358*b*, 362*a*, 362*b*, each have a width along the width axis of 0.010 inches. The interleg spacing along the width axis of legs 158*a* and 162*a* is 0.025 inches, as is the case for the spacing along the width axis between legs 158*b* and 162*b* and between 162*a* and 162*b*. Referring to FIG. 3D, the distal edges 165*a* and 165*b* of connectors 160 and 160*b* of the first igniter are straight and have a width along the igniter width axis of 0.045 inches. The heating zone length $l_{hz}$ of the TNL flat top igniter is 0.350 inches, and the heating zone length $l_{hz}$ of the TNL round top igniter is 0.344 inches. The proximal edges 167*a* and 167*b* are curved and have a radius of curvature of 0.025 inches. The distal edge 156 of third connector 156 has a width along the width axis of about 0.025 inches. The radius of curvature of proximal edge 159 of connector 156 is about 0.045 inches. With respect to the TNL round top igniter, the width of the legs 358*a*, 358*b*, 362*a*, 362*b* in the resistive heating section is 0.010 inches, and the interleg spacing is 0.018 inches. The radius of curvature of the distal edges 365*a* and 365*b* is 0.019 inches, and the radius of curvature of the proximal edges 367*a* and 367*b* is 0.009 inches. The distal edge 359 of third connector 356 has a radius of curvature of 0.009 inches, and the proximal edge 357 has a radius of curvature of 0.019 inches.

Ten TNL flat top and Ten TNL round top igniters are prepared. Each igniter is subjected to a 132V AC voltage that is cycled on for 30 seconds and off for 30 seconds until igniter failure is detected. For each type of igniter, the number of voltage cycles at the earliest failure is recorded as is the average number of life cycles for all tested parts of each type of igniter.

The results are shown in Table 5:

| 30 s on-off Life Cycle Test | TNL round-top | TNL flat-top |
|---|---|---|
| Ink composition | Yb-free | Yb-free |
| Thickness | 0.055" | 0.055" |
| Cycles at Earliest Failure | 6,125 | 5,676 |
| Average Life Cycles at 132 VAC | 65,059 | 28,189 |

The round top igniters demonstrated an unexpected improvement in both the number of cycles before the earliest failure and the average cycle life of all tested parts as compared to the flat top igniters. Without wishing to be bound by any theory, it is believed that the difference in cycle life is attributable to the fact that larger thermal stresses develop in the flat top igniters because of the sharp transition from legs 158*a* and 158*b* to connectors 160*a* and 160*b*. It is believed that the thermal mismatch during heating and cooling between the ceramic body and the conductive ink circuit is more pronounced in the case of the flat top design. Thus, in certain examples wherein the hot surface igniters described herein are used to ignite cooktops, a round top design is preferred as compared to a flat top design.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A burner system, comprising:

a burner comprising a crown having a plurality of burner ports, and a selectively energizable hot surface igniter in electrical communication with a power source;

a supply of combustible gas in selective fluid communication with the burner ports and the hot surface igniter;

a user control operable to selectively energize the hot surface igniter and selectively supply the combustible gas to the hot surface igniter, such that while a user is performing an ignition actuation operation with the user control, the combustible gas is supplied to the hot surface igniter, and the hot surface igniter is energized at a first average power level, when the user is performing a heating operation with the user control, combustible gas is supplied to the hot surface igniter, the hot surface igniter is energized at a second average power level, the second power level is not more than 90 percent of the first average power level, at the first power level the hot surface igniter reaches a surface temperature exceeding an autoignition temperature of the combustible gas within no more than 4 seconds of being energized, and at the second average power level, the hot surface igniter reaches a steady state surface temperature that exceeds the autoignition temperature of the combustible gas, wherein the user control is manipulable in a first dimension to supply power to the hot surface igniter and in a second dimension to supply the combustible gas to the hot surface igniter, and when the position of the user control with respect to the first dimension is such that the hot surface igniter is not energized, the user control is not manipulable with respect to the second dimension to supply combustible gas to the hot surface igniter.

2. The burner system of claim 1, wherein the burner is a cooktop burner, and the heating operation is a cooking operation.

3. The burner system of claim 1, wherein when energized at the first average power level, the igniter reaches a surface temperature of at least 1400° F. within no more than 3 seconds of being energized.

4. The burner system of claim 1, wherein at the second average power level, the hot surface igniter reaches a steady state surface temperature of at least about 1700° F.

5. The burner system of claim 1, wherein during an ignition actuation operation, the hot surface igniter ignites combustible gas within no more than 6 seconds after the combustible gas supply is placed in fluid communication with the hot surface igniter.

6. The burner system of claim 1, further comprising a flame sensor, wherein following an ignition actuation operation with the user control, the hot surface igniter is energized at the first average power level until the flame sensor senses the presence of a flame at the burner, and the hot surface igniter is energized at the second average power level once the flame sensor senses the flame at the burner.

7. The burner system of claim 1, further comprising:

a combustible gas valve that is openable and closable to selectively place the supply of combustible gas in fluid communication with the hot surface igniter; and an ignition circuit having a power supply and an ignition switch that is operable to place the power supply in electrical communication with the hot surface igniter, wherein the user control is operatively connected to the gas valve and the ignition switch.

8. The burner system of claim 1, wherein if a burner flame is extinguished while the user control is in a position at which combustible gas is supplied to the hot surface igniter, and the hot surface igniter is energized at the second average power level, the hot surface igniter re-ignites the combustible gas in no more than 6 seconds.

9. The burner system of claim 1, wherein the combustible gas is one selected from propane, natural gas, and butane.

10. The burner system of claim 1, wherein the user control is operatively connected to a switch that selectively places the hot surface igniter in electrical communication with the power source during the ignition actuation operation.

11. The burner system of claim 1, wherein if a burner flame is extinguished while the user control is in a position at which combustible gas is supplied to the hot surface igniter, and the hot surface igniter is energized at the second power level, the hot surface igniter re-ignites the cooking gas in no more than 6 seconds.

12. A burner system comprising:

a burner comprising a crown having a plurality of burner ports, and a selectively energizable hot surface igniter in electrical communication with a power source;

a supply of combustible gas in selective fluid communication with the burner ports and the hot surface igniter;

a user control operable to selectively energize the hot surface igniter and selectively supply the combustible gas to the hot surface igniter, such that while a user is performing an ignition actuation operation with the user control, the combustible gas is supplied to the hot surface igniter, and the hot surface igniter is energized at a first average power level, when the user is performing a heating operation with the user control, combustible gas is supplied to the hot surface igniter, the hot surface igniter is energized at a second average power level, the second power level is not more than 90 percent of the first average power level, at the first power level the hot surface igniter reaches a surface temperature exceeding an autoignition temperature of the combustible gas within no more than 4 seconds of being energized, and at the second average power level, the hot surface igniter reaches a steady state surface temperature that exceeds the autoignition temperature of the combustible gas, wherein during the ignition actuation operation, the hot surface igniter receives a combustible gas flow rate of $9.9\times10^{-3}$ L/min.

13. A method of operating a burner comprising a crown having a plurality of flutes, the method comprising:

energizing a hot surface igniter at a first average power;

supplying combustible gas to the hot surface igniter, such that the combustible gas ignites;

energizing the hot surface igniter at a second average power while supplying combustible gas to the hot surface igniter, wherein the second average power is not more than 90 percent of the first average power, and when operated at either the first average power or second average power, a surface temperature of the hot surface igniter exceeds the combustible gas autoignition temperature, the method further comprising determining that a flame is present with a flame sensor after the step of supplying combustible gas to the hot surface igniter and before the step of energizing the hot surface igniter at the second average power, and wherein the hot surface igniter comprises first and second ceramic tiles with an embedded resistive heating circuit, the flame sensor comprises a resistive temperature sensing circuit, and the step of determining whether a flame is present comprises determining one selected from a resistance of a resistive temperature sensing circuit and a change in resistance of the resistive temperature sensing circuit.

14. The method of claim 13, wherein during the step of energizing a hot surface igniter at a first average power, a surface temperature of the hot surface igniter reaches a temperature of at least 1400° F. in no more than six seconds.

15. The method of claim 13, wherein the hot surface igniter further comprises the temperature sensing circuit.

16. The method of claim 13, further comprising ceasing a flow of combustible gas to the burner when a combustible gas flame is determined by the flame sensor not to be present for a predetermined time period.

* * * * *